US007957958B2

(12) United States Patent
Sato

(10) Patent No.: US 7,957,958 B2
(45) Date of Patent: Jun. 7, 2011

(54) PITCH PERIOD EQUALIZING APPARATUS AND PITCH PERIOD EQUALIZING METHOD, AND SPEECH CODING APPARATUS, SPEECH DECODING APPARATUS, AND SPEECH CODING METHOD

(75) Inventor: Yasushi Sato, Kitakyushu (JP)

(73) Assignee: Kyushu Institute of Technology, Kitakyushu-shi (JP)

( * ) Notice: Subject to any disclaimer, the term of this patent is extended or adjusted under 35 U.S.C. 154(b) by 832 days.

(21) Appl. No.: 11/918,958

(22) PCT Filed: Mar. 24, 2006

(86) PCT No.: PCT/JP2006/305968
§ 371 (c)(1),
(2), (4) Date: Oct. 22, 2007

(87) PCT Pub. No.: WO2006/114964
PCT Pub. Date: Nov. 2, 2006

(65) Prior Publication Data

US 2009/0299736 A1 Dec. 3, 2009

(30) Foreign Application Priority Data

Apr. 22, 2005 (JP) ..... 2005-125815

(51) Int. Cl.
*G10L 11/04* (2006.01)

(52) U.S. Cl. ..... 704/207

(58) Field of Classification Search ..... 704/207
See application file for complete search history.

(56) References Cited

U.S. PATENT DOCUMENTS

| | | | | |
|---|---|---|---|---|
| 5,774,837 | A * | 6/1998 | Yeldener et al. | 704/208 |
| 5,787,391 | A * | 7/1998 | Moriya et al. | 704/225 |
| 7,039,581 | B1 * | 5/2006 | Stachurski et al. | 704/205 |
| 7,180,892 | B1 * | 2/2007 | Tackin | 370/389 |
| 7,263,480 | B2 * | 8/2007 | Minde et al. | 704/219 |
| 7,272,556 | B1 * | 9/2007 | Aguilar et al. | 704/230 |
| 2004/0030546 | A1 | 2/2004 | Sato | |
| 2005/0065788 | A1 * | 3/2005 | Stachurski | 704/229 |

FOREIGN PATENT DOCUMENTS

JP 03-080300 4/1991

(Continued)

OTHER PUBLICATIONS

Supplementary European Search Report dated Sep. 1, 2008, issued for the European patent application No. 06729916.4.

(Continued)

*Primary Examiner* — Michael N Opsasnick
(74) *Attorney, Agent, or Firm* — Edwards Angell Palmer & Dodge LLP

(57) ABSTRACT

To provide a speech coding technology that realizes a low bit rate and can suppress distortion of reproduction speech as compared with a conventional technology.

There are provided pitch detecting means 5 that detects a pitch frequency of an input speech signal, residual calculating means 6 that calculates the difference (residual frequency) between the pitch frequency and a reference frequency, a frequency shifter 4 that shifts a frequency of the input speech signal in proportional to the residual frequency in a direction for being close to the reference frequency and equalizes a pitch period, and orthogonal transforming means that orthogonally transforms the speech signal (pitch-equalizing speech signal) output by the frequency shifter 4 by a constant number of the pitch intervals and generates transforming coefficient data, and waveform coding means that encodes the transforming coefficient data.

20 Claims, 18 Drawing Sheets

FOREIGN PATENT DOCUMENTS

| | | | |
|---|---|---|---|
| JP | 3199128 | | 11/1993 |
| JP | 2003-108172 | | 4/2003 |
| JP | 2003-108200 | | 4/2003 |
| JP | 2004-012908 | | 1/2004 |
| WO | WO-02/097798 | A1 | 12/2002 |

OTHER PUBLICATIONS

Toshio Kanno et al., "Generation of Excitation Signal for Speech Analysis-Synthesis System Using Phase Characteristic," IEICE Technical Report [Onsei], SP91-80, vol. 91, No. 347, Nov. 22, 1991, p. 31-36.

Cheng-Yuan Lin et al., "New Refinement Schemes for Voice Conversion," Multimedia and Expo, ICME '03. Proceedings, vol. 2, 2003, pp. II-725-II-728.

Manfred R. Schroeder et al., "Code-excited Linear Prediction (CELP): High-Quality Speech at Very Low Bit Rates," Proceedings of ICASSP '85, 1985, pp. 25.1.1-25.1.4.

Hitoshi Kiya, "Multi rate Signal Processing in Series of Digital Signal Processing (vol. 14)", first edition, Oct. 6, 1995, pp. 34 to 49-78 to 79.

* cited by examiner detection of voiced sound "s" ("す")

(a)

spectrum after dividing into bands (b)

orthogonal transforming characteristic

"arayuru genjitsu wo subete jibunnohoue nejimagetanoda"
("あらゆる げんじつ を すべて じぶんのほうへ ねじまげたのだ")

PITCH PERIOD EQUALIZING APPARATUS AND PITCH PERIOD EQUALIZING METHOD, AND SPEECH CODING APPARATUS, SPEECH DECODING APPARATUS, AND SPEECH CODING METHOD

TECHNICAL FIELD

The present invention relates to a pitch period equalizing technology that equalizes a pitch period of a speech signal containing a pitch component and a speech coding technology using this.

BACKGROUND ART

Currently, in the speech coding field, at a low bit-rate not more than 10 kbps, Code Excited Linear Prediction Coding Encoding (hereinafter, referred to as "CELP") is widely used (refer to Non-Patent Document 1). The CELP coding performs modeling of a speech generating mechanism of the human being by a sound source component (vocal cord) and a spectrum envelope component (vocal tract) and encodes parameters thereof.

On the encoding side, the speech is divided on the basis of a frame unit, and frames are encoded. The spectrum envelope component is calculated with an AR model (Auto-Regressive model) of the speech based on linear prediction, and is given as a Linear Prediction Coding (hereinafter, referred to as "LPC") coefficient. Further, the sound source component is given as a prediction residual. The prediction residual is separated into period information indicating pitch information, noise information serving as sound source information, and gain information indicating a mixing ratio of the pitch and the sound source. The information comprises code vectors stored in a code book. The code vector is determined by a method for passing code vectors through a filter to synthesize a speech and searching one of the speeches having the most approximate input waveform, i.e., closed loop search using AbS (Analysis by Synthesis) method.

Further, on the decoding side, the encoded information is decoded, and the LPC coefficient, the period information (pitch information), noise sound source information, and the gain information are restored. The pitch information is added to the noise information, thereby generating an excitation source signal. The excitation source signal passes through a linear-prediction synthesizing filter comprising the LPC coefficient, thereby synthesizing a speech.

FIG. 16 is a diagram showing an example of the basic structure of a speech coding apparatus using the CELP coding (Refer to Patent Document 1 and FIG. 9).

An original speech signal is divided on the basis of a frame unit having a predetermined number of samples, and the divided signals are input to an input terminal 101. A linear-prediction coding analyzing unit 102 calculates the LPC coefficient indicating a frequency spectrum envelope characteristic of the original speech signal input to the input terminal 101. Specifically speaking, an autocorrelation function of the frame is obtained and the LPC coefficient is calculated with Durbin recursive solution.

An LPC coefficient encoding unit 103 quantizes and encodes the LPC coefficient, thereby generating the LPC coefficient. The quantization is performed with transformation of the LPC coefficient into a Line Spectrum Pair (LSP) parameter, a Partial auto-Correlation (PARCOR) parameter, or a reflection coefficient having high quantizing efficiency in many cases. An LPC coefficient decoding unit 104 decodes the LPC coefficient code and reproduces the LPC coefficient. Based on the reproduced LPC coefficient, the code book is searched so as to encode a prediction residual component (sound source component) of the frame. The code book is searched on the basis of a unit (hereinafter, referred to as a "subframe") obtained by further dividing the frame in many cases.

Herein, the code book comprises an adaptive code book 105, a noise code book 106, and a gain code book 107.

The adaptive code book 105 stores a pitch period and an amplitude of a pitch pulse as a pitch period vector, and expresses a pitch component of the speech. The pitch period vector has a subframe length obtained by repeating a residual component (drive sound source vector corresponding to just-before one to several frames quantized) until previous frames for a preset period. The adaptive code book 105 stores the pitch period vectors. The adaptive code book 105 selects one pitch period vector corresponding to a period component of the speech from among the pitch period vectors, and outputs the selected vector as a candidate of a time-series code vector.

The noise code book 106 stores a shape excitation source component indicating the remaining waveform obtained by excluding the pitch component from the residual signal, as an excitation vector, and expresses a noise component (non-periodical excitation) other than the pitch. The excitation vector has a subframe length prepared as white noise as the base, independently of the input speech. The noise code book 106 stores a predetermined number of the excitation vectors. The noise code book 106 selects one excitation vector corresponding to the noise component of the speech from among the pitch excitation vectors, and outputs the selected vector as a candidate of the time-series code vector corresponding to a non-periodic component of the speech.

Further, the gain code book 107 expresses gain of the pitch component of the speech and a component other than this.

Gain units 108 and 109 multiply pitch gain $g_a$ and shape gain $g_r$ of the candidates of the time-series code vectors input from the adaptive code book 105 and the noise code book 106. The gains $g_a$ and $g_r$ are selected and output by the gain code book 107. Further, an adding unit 110 adds both the gain and generates a candidate of the drive sound source vector.

A synthesizing filter 111 is a linear filter that sets the LPC coefficient output by the LPC coefficient decoding unit 104 as a filter coefficient. The synthesizing filter 111 performs filtering of the candidate of the drive sound source vector output from the adding unit 110, and outputs the filtering result as a reproducing speech candidate vector.

A comparing unit 112 subtracts the reproducing speech candidate vector from the original speech signal vector, and outputs distortion data. The distortion data is weighted by an auditory weighting filter 113 with a coefficient corresponding to the property of the sense of hearing of the human being. In general, the auditory weighting filter 113 is a moving-average autoregressive filter of a tenth-order, and relatively emphasizes a peak portion of formant. The weighting is performed for the purpose of encoding to reduce quantizing noises within a frequency band at the bottom having a small value of the speech spectrum envelop.

A distance minimizing unit 114 selects a period signal, noise code, and gain code, having the minimum squared error of the distortion data output from the auditory weighting filter 113. The period signal, noise code, and gain code are individually sent to the adaptive code book 105, the noise code book 106, and the gain code book 107. The adaptive code book 105 outputs the candidate of the next time-series code vector based on the input period signal. The noise code book 106 outputs the candidate of the next time-series code vector on the basis of the input noise signal. Further, the gain code book 107 outputs the next gains $g_a$ and $g_r$ based on the input gain code.

The distance minimizing unit 114 determines, as the drive sound source vector of the frame, the period signal, noise code, and gain code at the time for minimizing the distortion data output from the auditory weighting filter 113 by repeating this AbS loop.

A code sending unit 115 converts the period signal, noise code, and gain code determined by the distance minimizing unit 114 and the LPC coefficient code output from the LPC coefficient encoding unit 103 into bit-series code, and further adds correcting code as needed and outputs the resultant code.

FIG. 17 shows an example of the basic structure of a speech decoding apparatus using the CELP encoding (refer to Patent Document 1 and FIG. 11).

The speech decoding apparatus has substantially the same structure as that of the speech coding apparatus, except for no-search of the code book. A code receiving unit 121 receives the LPC coefficient code, period code, noise code, and gain code. The LPC coefficient code is sent to an LPC coefficient decoding unit 122. The LPC coefficient decoding unit 122 decodes the LPC coefficient code, and generates the LPC coefficient (filter coefficient).

The adaptive code book 123 stores the pitch period vectors. The pitch period vector has a subframe length obtained by repeating the residual component (drive sound source vector corresponding to just-before one to several frames decoded) until previous frames for a preset period. The adaptive code book 123 selects one pitch period vector corresponding to the period code input from the code receiving unit 121, and outputs the selected vector as the time-series code vector.

The noise code book 124 stores excitation vectors. The excitation vectors have a subframe length prepared based on white noise, independent of the input speech. One of the excitation vectors is selected in accordance with the noise code input from the vector code receiving unit 121, and the selected vector is output as a time-series code vector corresponding to a non-periodic component of the speech.

Further, the gain code book 125 stores gain (pitch gain $g_a$ and shape gain $g_r$) of the pitch component of the speech and another component. The gain code book 125 selects and outputs a pair of the pitch gain $g_a$ and shape gain $g_r$ corresponding to the gain code input from the code receiving unit 121.

Gain units 126 and 127 multiply the pitch gain $g_a$ and shape gain $g_r$ of the time-series code vectors output from the adaptive code book 123 and the noise code book 124. Further, an adding unit 128 adds both the gain and generates a drive sound source vector.

A synthesizing filter 129 is a linear filter that sets the LPC coefficient output by the LPC coefficient decoding unit 122, as a filter coefficient. The synthesizing filter 129 performs filtering of the candidate of the drive sound source vector output from the adding unit 128, and outputs the filtering result as a reproducing speech to a terminal 130.

MPEG standard and audio devices widely use subband coding. With the subband coding, a speech signal is divided into a plurality of a frequency bands (subbands), and a bit is assigned in accordance with signal energy in the subband, thereby efficiently performing the coding. As a technology for applying the subband coding to the speech coding, technologies disclosed in Patent Documents 2 to 4 are well-known.

With the speech coding disclosed in Patent Documents 2 to 4, the speech signal is basically encoded by the following signal processing.

First, the pitch is extracted from an input original speech signal. Then, the original speech signal is divided into pitch intervals. Subsequently, the speech signals at the pitch intervals obtained by the division are resampled so that the number of samples at the pitch interval is constant. Further, the resampled speech signal at the pitch interval is subjected to orthogonal transformation such as DCT, thereby generating subband data comprising (n+1) pieces of data. Finally, the (n+1) pieces of data obtained on time series are subjected to filtering, thereby removing the component having a frequency over a predetermined one in the time-based change in intensity to smooth the data and generating (n+1) pieces of data on acoustic information. Further, the ratio of a high-frequency component is determined on the basis of a threshold from the subband data, thereby determining whether or not the original speech signal is friction sound and outputting the determining result as information on the friction sound.

Finally, the original speech signal is divided into information (pitch information) indicating the original pitch length at the pitch interval, acoustic information containing the (n+1) pieces of acoustic information data, and fricative information, and the divided information is encoded.

FIG. 18 is a diagram showing an example of the structure of a speech coding apparatus (speech signal processing apparatus) disclosed in Patent Document 2. The original speech signal (speech data) is input to a speech data input unit 141. A pitch extracting unit 142 extracts a basic-frequency signal (pitch signal) at the pitch from the speech data input to the speech data input unit 141, and segments the speech data by a unit period (pitch interval as one unit) of the pitch signal. Further, the speech data at the pitch interval as the unit is shifted and adjusted so as to maximize the correlation between the speech data and the pitch signal, and the adjusted data is output to the pitch-length fixing unit 143.

A pitch-length fixing unit 143 resamples the speech data at the pitch interval as the unit so as to substantially equalize the number of samples at the pitch interval as the unit. Further, the resampled speech data at the pitch interval as the unit is output as pitch waveform data. Incidentally, the resampling removes information on the length (pitch period) of the pitch interval as the unit and the pitch-length fixing unit 143 therefore outputs information on the original pitch length at the pitch interval as the unit, as the pitch information.

A subband dividing unit 144 performs orthogonal transformation, such as DCT, of the pitch waveform data, thereby generating subband data. The subband data indicates time-series data containing (n+1) pieces of spectrum intensity data, indicating the intensity of a basic frequency component of the speech and n intensities of high-harmonic components of the speech.

A band information limiting unit 145 performs filtering of the (n+1) pieces of spectrum intensity data forming the subband data, thereby removing a component having a frequency over a predetermined one during the time-based change in the (n+1) pieces of spectrum intensity data. This is processing performed to remote the influence of the aliasing generated as a result of the resampling by the pitch-length fixing unit 143.

The subband data filtered by the band information limiting unit 145 is nonlinearly quantized by a non-linear quantizing unit 146, is encoded by a dictionary selecting unit 147, and is output as the acoustic information.

A friction sound detecting unit 149 determines, based on the ratio of the high-frequency components to all spectrum intensities of the subband data, whether the input speech data is voiced sound or unvoiced sound (friction sound). Further, the friction sound detecting unit 149 outputs friction sound information as the determining result.

As mentioned above, the fluctuation of the pitch is removed before dividing the original speech signal into the subband, and the orthogonal transformation is performed every pitch interval, thereby dividing the signal into subbands. Accordingly, since the time-based change in spectrum intensity of the subband is small, a high compressing-rate is realized with respect to the acoustic information.

[Patent Document 1]

Japanese Patent Publication No. 3199128

[Patent Document 2]

Japanese Unexamined Patent Application Publication No. 2003-108172

[Patent Document 3]

Japanese Unexamined Patent Application Publication No. 2003-108200

[Patent Document 4]

Japanese Unexamined Patent Application Publication No. 2004-12908

[Non-Patent Document 1]

Manfred R. Schroeder and Bishnu S. Atal, "Code-excited Linear Prediction (CELP): High-Quality Speech at Very Low Bit Rates", Proceedings of ICASSP '85, pp. 25.1.1 to 25.1.4, 1985.

[Non-Patent Document 2]

Hitoshi KIYA, "Multirate Signal Processing in Series of Digital Signal Processing (Volume 14)", first edition, Oct. 6, 1995, pp. 34 to 49 and 78 to 79.

DISCLOSURE OF INVENTION

Problems to be Solved by the Invention

With the conventional CELP coding, the pitch component of the residual signal is selected from among the pitch period vectors provided for the adaptive code book. Further, the sound source component of the residual signal is selected from among fixed excitation vectors provided for the noise code book. Therefore, upon precisely reproducing the input speech, the number of candidates of the pitch period vectors in the adaptive code book and the excitation vectors in the noise code book requires to increase as much as possible.

However, if increasing the number of candidates, the memory capacities of the adaptive code book and the noise code book are enormous, and the implementation area thus increases. Further, if excessively increasing the number of candidates, the amount of period code and the amount of noise code increase in proportional to the logarithm of the number of candidates. Therefore, in order to realize a low bit-rate, the number of candidates in the adaptive code book and the noise code book cannot be large.

Therefore, the candidate is selected from among a limited number of the pitch period vectors and a limited number of the excitation vectors so as to approximate the sound source component of the input speech, and the reduction in distortion is thus limited. In particular, the sound source component most accounts for the speech signal, is however like noise, and cannot be predicted. Accordingly, a certain amount of the distortion is caused in the reproducing speech and the higher sound quality is limited.

In the speech coding disclosed in Patent Documents 2 to 4, since the speech signal is encoded by the subband coding, the coding with high sound quality and high compressing ratio is possible.

However, this coding has a problem of the aliasing and a problem that the speech signal is modulated by the fluctuation of the pitch, when the pitch-length fixing unit resamples (generally, down-samples) the speech signal.

The former is a phenomenon that the down-sampling causes the aliasing component, and this can be prevented by using a decimation filter, similarly to a general decimator (refer to, e.g., Non-Patent Document 2).

On the other hand, the latter is caused by the situation that the signals at the fluctuated period are set every pitch interval to a predetermined number of samples and the fluctuation thus modulates the speech signal. That is, the pitch-length fixing unit 143 performs resampling of the speech data at the fluctuated period every pitch interval so as to set a predetermined number of samples every pitch interval. In this case, the period at the fluctuated pitch is substantially 1/10 of the pitch period, and is greatly long. Therefore, if forcedly resampling the speech signals at the fluctuated pitch periods as mentioned above so as to set the speech signals at the fluctuated pitch period to the same number of samples at each pitch interval, the frequency at the fluctuated pitch modulates the frequency of the information. Therefore, upon restoring again the speech signal from the acoustic information frequency-modulated by the frequency at the fluctuated pitch, the modulated component (hereinafter, referred to as a "modulated component due to the pitch fluctuation") due to the pitch fluctuation appears as a ghost tone, thereby causing the distortion in the speech.

In order to prevent this phenomenon, with the speech coding apparatus disclosed in Patent Documents 2 and 3, the band information limiting unit 145 performs filtering of the spectrum intensity data of the subband component output by the subband dividing unit 144, thereby removing the modulated component due to the pitch fluctuation appearing as the time-based change in spectrum intensity data.

However, if excessively narrowing the pass band by the band information limiting unit 145, even the original component due to the temporal change in original speech signal except for the modulated component due to the pitch fluctuation is smoothed, this can rather result in causing the distortion of the speech signal. On the other hand, if widening the pass band by the band information limiting unit 145, the modulated component due to the pitch fluctuation passes and the ghost tone appears.

Further, with the speech coding apparatus disclosed in Patent Document 4, the spectrum intensity data of the subband output by the subband dividing unit 144 is averaged, thereby removing the modulated component due to the pitch fluctuation. However, this averaging loses the original component due to the time-based change of the original speech signal, except for the modulated component due to the pitch fluctuation, and this results in the distortion of the speech signal.

Therefore, the speech coding disclosed in Patent Documents 2 to 4 does not enable the reduction in modulated component due to the pitch fluctuation, and includes a problem that the distortion of the speech signal due to the modulated component is necessarily caused.

Then, it is an object of the present invention to provide a speech coding technology by which a low bit-rate is realized and the distortion of the reproducing speech can be reproduced as compared with the conventional ones, without the distortion including the frequency modulation due to the pitch fluctuation and a pitch period equalizing technology suitable for the use thereof.

Means for Solving the Problems

With the speech signal including the pitch component, the waveforms at adjacent pitch intervals in the same phoneme are relatively similar to each other. Therefore, by transformation and coding at each pitch interval or at a predetermined number of the pitch intervals, the spectra at the adjacent pitch intervals are similar, and time-series spectra having large redundancy can be obtained. Further, the coding of the data can improve the coding efficiency. In this case, the code book is not used. Further, since the waveforms of the original speech are encoded without operations, the reproducing speech with low distortion can be obtained.

However, the pitch frequency of the original speech signal varies depending on the difference between the sexes, the individual difference, the phoneme difference, the difference in feeling and conversation contents. Further, even at the same phoneme, the pitch periods are fluctuated and changed. Therefore, if executing the transformation and coding at the pitch interval without operations, the time-based change in obtained spectrum train is large and high coding efficiency cannot be expected.

Then, the speech coding method according to the present invention uses a method for dividing information included in the original speech having the pitch component into information on a basic frequency at the pitch, information on the fluctuation at the pitch period, and information on the waveform at the individual pitch interval. The original speech signal obtained by removing the information on the basic frequency at the pitch and the information on the fluctuation at the pitch period have a constant pitch period, and the transformation and coding at the pitch interval or at a constant number of the pitch intervals are easy. Further, since the correlation between the waveforms between the adjacent pitch intervals is large, the spectra obtained by the transformation and coding can be intensive to the equalized pitch frequency and the high-harmonic component thereof, thereby obtaining high coding efficiency.

The speech coding method according to the present invention uses a pitch period equalizing technology in order to extract and remove the information on the basic frequency at the pitch and the information on the fluctuation of the pitch period from the original speech signal. Hereinbelow, a description will be given of the structure and operation of pitch period equalizing apparatus and method and speech coding apparatus and method according to the present invention.

[Structure and Operation of the Invention]

With the first structure of a pitch period equalizing apparatus according to the present invention, the pitch period equalizing apparatus that equalizes a pitch period of voiced sound of an input speech signal, comprises: pitch detecting means that detects a pitch frequency of the speech signal; residual calculating means that calculates a residual frequency, as the difference obtained by subtracting a predetermined reference frequency from the pitch frequency; and a frequency shifter that equalizes the pitch period of the speech signal by shifting the pitch frequency of the speech signal in a direction for being close to the reference frequency on the basis of the residual frequency. The frequency shifter comprises: modulating means that modulates an amplitude of the input signal by a predetermined modulating wave and generates the modulated wave; a band-pass filter that allows only a signal having a single side band component of the modulated wave to selectively pass through; demodulating means that demodulates the modulated wave subjected to the filtering of the band-pass filter by a predetermined demodulating wave and outputs the demodulated wave as an output speech signal; and frequency adjusting means that sets, as a predetermined basic carrier frequency, one of a frequency of the modulating wave used for modulation of the modulating means and a frequency of the demodulating wave used for demodulation of the demodulating means, and sets the other frequency to a frequency obtained by subtracting the residual frequency from the basic carrier frequency.

With this structure, upon equalizing the pitch period of the speech signal to a reference period (reciprocal of the reference frequency), the amplitude of the input speech signal is modulated once by the modulating wave, and the modulated wave passes through the band-pass filter, and the waveband on the bottom is removed. Further, the modulated wave having a single side band is demodulated with the demodulating wave. In this case, when the residual frequency is 0, both the modulating wave and the demodulating wave are set as basic carrier frequencies. However, when the residual frequency is not 0, any of the modulating wave and the demodulating wave is set to a value obtained by subtracting the residual frequency from the basic carrier frequency by the frequency adjusting means. As a consequence, the difference between the basic frequency of the input speech signal and the reference frequency is canceled, and the pitch periods of the output speech signal are equalized to the reference period.

As mentioned above, the pitch periods are equalized to a predetermined reference period, thereby removing a jitter component and a change component of the pitch frequency that changes depending on the difference between the sexes, the individual difference, the phoneme, the feeling, and the conversation contents of the pitch included in the speech signal.

Further, the modulation of the single side band is used upon equalizing the pitch period of the speech signal to the reference period and the problem of the aliasing is not caused. Further, the resampling is not used upon equalizing the pitch period. Therefore, unlike the conventional methods (Patent Documents 2 to 4), the problem that the speech signal is not demodulated due to the fluctuation of the pitch is not caused. Thus, the distortion due to the equalization is not caused in the output speech signal having the equalized pitch period.

The information included in the input speech signal is divided into information on the reference frequency at the pitch, information on the fluctuation of the pitch frequency every pitch, and information on the waveform component superimposed to the pitch. The information is individually obtained as the reference frequency, the residual frequency, and the waveform at one pitch interval of the speech signal after the equalization. The reference frequency is substantially constant every phoneme, and the coding efficiency is high in the coding. Further, within the phoneme, the fluctuation width of the pitch frequency is generally small, the bin-frequency therefore has a narrow range, and the coding efficiency of the residual frequency is high in the coding. Furthermore, the fluctuation of the pitch is removed from the waveform within one pitch interval of the speech signal after the equalization, and the number of samples is the same at the pitch intervals. In addition, since the waveforms at the pitch intervals within the same phoneme have a strong similarity, the number of samples is equalized to be the same at the pitch intervals and the waveforms at the pitch intervals have high similarity. Thus, the transformation and coding are performed by one to a predetermined number of pitch intervals, thereby greatly compressing the amount of code. Accordingly, the coding efficiency of the speech signal can be improved.

With the structure according to the present invention, the pitch periods of voiced sound including the pitch from among the speech signals are equalized. Therefore, unvoiced sound and noise without including the pitch may be additionally separated by a method using a well-known cepstrum analysis and feature analysis of spectrum shape.

Further, the pitch period equalizing apparatus can be applied to a sound matching technology such as sound search, as well as the speech coding. That is, the pitch intervals are equalized to the same period, thereby increasing the similarity of the waveforms at the pitch intervals. Further, the comparison of the speech signals is easy. Therefore, upon applying the pitch period equalizing apparatus to the speech search, the speech matching precision can be improved.

With the second structure of the pitch period equalizing apparatus according to the present invention, in the first structure, the pitch detecting means comprises: input pitch detecting means that detects a pitch frequency (hereinafter, referred to as an "input pitch frequency") of the input speech signal input to the frequency shifter; and output pitch detecting means that detects a pitch frequency (hereinafter, referred to as an "output pitch frequency") of the output speech signal output from the frequency shifter. The pitch period equalizing apparatus further comprises: pitch averaging means that calculates an average pitch frequency as the time-based average of the input pitch frequencies, and the residual calculating means sets the average pitch frequency as a reference frequency, and calculates a residual frequency as the difference between the output pitch frequency and the reference frequency.

With this structure, even if the pitch frequency within the phoneme includes the difference between the sexes, the individual difference, the difference due to the phoneme, and the difference due to the feeling or conversation contents, the time-based average of the input pitch frequencies is used as the reference frequency, thereby setting the best frequency corresponding to the differences as the reference frequency.

Further, the difference between the output pitch frequency and the reference frequency is set as the residual frequency and this frequency is fedback to the amount of shift of the frequency shifter. Accordingly, an error caused by equalizing the pitch period by the frequency shifter is reduced, and the information on the fluctuation of the pitch frequencies every pitch can be efficiently separated from the information on the waveform component superimposed to the pitch.

Herein, the time-based average by the pitch averaging means may be a simple geometric average and a weighted average. Further, a low-pass filter can be used as the pitch averaging means. In this case, the time-based average of the pitch averaging means is a geometric average.

With the third structure of the pitch period equalizing apparatus according to the present invention, in the first structure, the pitch detecting means is input pitch detecting means that detects a pitch frequency (hereinafter, referred to as an "input pitch frequency") of the input speech signal input to the frequency shifter, and comprises: pitch averaging means that calculates an average pitch frequency as the time-based average of the input pitch frequencies. The residual calculating means sets the average pitch frequency as a reference frequency and calculates a residual frequency as the difference between the input pitch frequency and the reference frequency.

As mentioned above, the time-based average of the input pitch frequencies is used as the reference frequency, thereby setting the best frequency as the reference frequency.

Further, the difference between the input pitch frequency and the reference frequency is set as the residual frequency and this frequency is fed forward to the amount of shift of the frequency shifter. Accordingly, an error caused by equalizing the pitch period by the frequency shifter is reduced, and the information on the fluctuation of the pitch frequencies every pitch can be efficiently separated from the information on the waveform component superimposed to the pitch.

With the fourth structure of the pitch period equalizing apparatus according to the present invention, in the first structure, the pitch detecting means is output pitch detecting means that detects a pitch frequency (hereinafter, referred to as an "output pitch frequency") of the output speech signal output from the frequency shifter, and comprises: pitch averaging means that calculates an average pitch frequency as the time-based average of the output pitch frequencies. The residual calculating means sets the average pitch frequency as a reference frequency, and calculates a residual frequency between the output pitch frequency and the reference frequency.

As mentioned above, the time-based average of the output pitch frequencies is used as the reference frequency, thereby setting the best frequency as the reference frequency.

Further, the difference between the input pitch frequency and the reference frequency is set as the residual frequency and this frequency is fedback to the amount of shift of the frequency shifter. Accordingly, an error caused by equalizing the pitch period by the frequency shifter is reduced, and the information on the fluctuation of the pitch frequencies every pitch can be efficiently separated from the information on the waveform component superimposed to the pitch.

With the fifth structure of the pitch period equalizing apparatus according to the present invention, in the first structure, the pitch detecting means is input pitch detecting means that detects a pitch frequency (hereinafter, referred to as an "input pitch frequency") of the input speech signal input to the frequency shifter, and comprises reference frequency generating means that outputs the reference frequency. The residual calculating means calculates a residual frequency as the difference between the input pitch frequency and the reference frequency.

As mentioned above, the determined frequency output by the reference frequency generating means is used as the reference frequency, of the information on the speech included in the input speech signal, the information on the basic frequency at the pitch and the information on the fluctuation of the pitch frequency are separated as the residual frequency. Further, the information on the waveform component superimposed to the pitch is separated as the waveform at one pitch interval of the speech signal after the equalization.

The difference between the sexes, the individual difference, the difference due to the phoneme, or the difference due to the conversation contents of the basic frequency at the pitch is generally narrow. Further, the fluctuations of the pitch frequency at the pitches are generally small. Therefore, the residual frequency has a narrow range and the coding efficiency in the coding is high. Further, the fluctuation component of the pitch is removed from the waveform within one pitch interval of the speech signal after the equalization and the transformation and coding therefore can greatly compress the amount of code. Accordingly, the coding efficiency of the speech signal can be improved.

With the sixth structure of the pitch period equalizing apparatus according to the present invention, in the first structure, the pitch detecting means is output pitch detecting means that detects a pitch frequency (hereinafter, referred to as an "output pitch frequency") of the output speech signal output from the frequency shifter, and comprises: reference frequency generating means that outputs the reference frequency. The residual calculating means calculates a residual frequency as the difference between the output pitch frequency and the reference frequency.

As mentioned above, similarly to the fifth structure, the coding efficiency of the speech signal can be improved by using, as the reference frequency, the determined frequency output by the reference-frequency generating means.

With the first structure of a speech coding apparatus according to the present invention, the speech coding apparatus that encodes an input speech signal, comprises: the pitch period equalizing apparatus according to any one of claims 1 to 6 that equalizes a pitch period of voiced sound of the speech signal; and orthogonal transforming means that orthogonally transforms a speech signal (hereinafter, a "pitch-equalizing speech signal") output by the pitch period equalizing apparatus at an interval of a constant number of pitches, and generates transforming coefficient data of a subband.

With this structure, as mentioned above, in the pitch period equalizing apparatus, the information on the basic frequency at the pitch, the information on the fluctuation of the pitch frequency every pitch, and the information on the waveform component superimposed to the pitch, included in the input speech signal are individually separated into the reference frequency, the residual frequency, and the waveform at one pitch interval of the speech signal (speech signal at the equalized pitch) after the equalization.

Herein, a waveform (hereinafter, referred to as a "unit pitch interval waveform") within one pitch interval of the obtained pitch-equalizing speech signal is obtained by removing the fluctuation (jitter) of the pitch period every pitch and the change in pitch from the speech waveform superimposed to the basic pitch frequency. Therefore, in the orthogonal transformation, the pitch interval is orthogonally transformed with the same resolution at the same sampling interval. Therefore, the transformation and coding at each pitch interval are easily executed. Further, the correlation between the waveforms at the unit pitch intervals at the adjacent pitch intervals in the same phoneme is large.

Therefore, the pitch-equalizing speech signal is orthogonally transformed by a constant number of pitch intervals, the resultant data is set as transforming coefficient data of each subband, and high coding efficiency thus can be obtained.

Herein, as the "constant number of the pitch intervals" for orthogonal transformation by the orthogonal transforming means, the one pitch interval or two or more integral-multiple pitch intervals can be used. However, in order to minimize the time-based change in transforming coefficient data of the subband and obtain the high coding efficiency, the one pitch interval is preferable. The frequency of the subband at two or more pitch intervals includes a frequency other than the high-harmonic component of the reference frequency. On the other hand, if setting one pitch interval, all the frequencies of the subband have the high-harmonic component of the reference frequency. As a consequence, the time-based change in transforming coefficient data of the subband is minimum.

Further, the pitch frequency output by the pitch detecting means and the residual frequency output by the residual calculating means are encoded, thereby encoding the information on the basic frequency at the pitch and the information on the fluctuation of the pitch frequency at each pitch interval. The basic frequency at the pitch is substantially constant every phoneme and the coding efficiency is therefore high in the coding. Further, since the width of the fluctuation of the pitch is generally small within the phonemes, the residual frequency has a narrow range and the coding efficiency is high in the coding. Therefore, the coding efficiency is high as a whole.

In addition, as compared with the CELP method, the speech coding apparatus according to the present invention is characterized in that the speech coding at a low bit-rate is accomplished without using the code book. The code book is not used and the code book is not therefore prepared for the speech coding apparatus and speech decoding apparatus. Accordingly, the implementation area of hardware can be reduced.

Further, upon using the code book, the degree of distortion of the speech is determined depending on the matching degree between the input speech and the candidate of the code book. Therefore, upon inputting speech greatly different from the candidates in the code book, large distortion appears. Upon preventing this phenomenon, the number of candidates in the code book needs to be large. However, if increasing the number of candidates, the entire amount of codes is increased in proportional to the logarithm of the number of candidates. Therefore, since the number of candidates in the code book is not so large so as to realize the low bit-rate, the distortion cannot be small to some degree.

However, with the speech coding apparatus according to the present invention, the input speech is directly encoded by the transformation and coding. As a consequence, the best coding suitable to the input speech is always performed. Therefore, the distortion of the speech due to the coding can be suppressed at the minimum level, and the speech coding at a high SN ratio can be accomplished.

With the second structure of the speech coding apparatus according to the present invention, in the first structure, the speech coding apparatus further comprises: resampling means that performs resampling of the pitch-equalizing speech signal output by the pitch period equalizing apparatus so that the number of samples at one pitch interval is constant.

With this structure, upon using, as the reference frequency, an average of the input pitch frequencies or an average pitch frequency as an average of output pitch frequencies, when the reference frequency is gradually time-based changed, the resampling always sets the pitch interval to a constant number of samples, thereby simply structuring the orthogonal transforming means. That is, as the orthogonal transforming means, a PFB (Polyphase Filter Bank) is actually used. However, upon changing the number of samples at the pitch interval, the number of available filters (the number of subbands) is changed. Thus, an unused filter (subband) is caused and this is waste. Therefore, this waste is reduced by always setting the pitch interval to a constant number of samples with the resampling.

Herein, it is noted that the resampling using the resampling means is different from the resampling disclosed in Patent Documents 2 to 4. The resampling disclosed in Patent Documents 2 to 4 is performed so as to set the pitch period having the fluctuation to a constant pitch period. Therefore, the resampling interval of the pitch intervals is vibrated in accordance with the term of the fluctuation of the pitch period (approximately $10^{-3}$ sec). Therefore, as a result of the resampling, an advantage for modulating the frequency at the term of the fluctuation of the pitch period is obvious. On the other hand, the resampling according to the present invention is performed so as to prevent the number of samples at each pitch interval of the speech signal at the already-equalized pitch period, due to the change in reference frequency. The change in reference frequency is generally gradual (approximately, 100 msec), and the influence of the fluctuation in frequency due to the resampling does not cause any problems.

A speech decoding apparatus according to the present invention decodes an original speech signal on the basis of a pitch-equalizing speech signal obtained by equalizing a pitch frequency of the original speech signal to a predetermined reference frequency and by resolving the equalized pitch frequency to a subband component with orthogonal transformation and a residual frequency signal as the difference obtained by subtracting the reference frequency from the pitch frequency of the original speech signal. The speech decoding apparatus comprises: inverse-orthogonal transforming means that restores a pitch-equalizing speech signal by orthogonally inverse-transforming the pitch-equalizing speech signal orthogonally-transformed at a constant number of pitches; and a frequency shifter that generates the restoring speech signal by shifting the pitch frequency of the pitch-equalizing speech signal to be close to a frequency obtained by adding the residual frequency to the reference frequency. The frequency shifter comprises: modulating means that modulates an amplitude of the pitch-equalizing speech signal by a predetermined modulating wave and generates the modulated wave; a band-pass filter that allows only a signal of a single side band component of the modulated signal to selectively pass through; demodulating means that demodulates the modulated wave subjected to the filtering by the band-pass filter by a predetermined demodulating wave and outputs the demodulated wave as a restoring speech signal; and frequency adjusting means that sets, as a predetermined basic carrier frequency, one of a frequency of the modulating wave used for modulation by the modulating means and a frequency of the demodulating wave used for demodulation by the demodulating means, and sets the other frequency to a value obtained by adding the residual frequency to the basic carrier frequency.

With this structure, the speech signal encoded by the speech coding apparatus having the first or second structure can be decoded.

With the first structure of a pitch period equalizing method according to the present invention, a pitch period equalizing method equalizes a pitch period of voiced sound of an input speech signal (hereinafter, referred to as an "input speech signal"). The pitch period equalizing method comprises: a frequency shifting step of inputting the input speech signal to a frequency shifter and obtaining an output signal (hereinafter, referred to as an "output speech signal") from the frequency shifter; an output pitch detecting step of detecting a pitch frequency (hereinafter, referred to as an "output pitch frequency") of the output speech signal; and a residual frequency calculating step of calculating a residual frequency as the difference between the output pitch frequency and a predetermined reference frequency. The frequency shifting step comprises: a frequency setting step of setting one of a frequency of a modulating wave used for modulation and a frequency of a demodulating wave used for demodulation to a predetermined basic carrier frequency, and setting the other frequency to a frequency obtained by subtracting the residual frequency calculated by the residual frequency calculating step from the basic carrier frequency; a modulating step of modulating an amplitude of the input speech signal by the modulating wave and generating the modulated wave; a band reducing step of performing filtering of the modulated wave by a band-pass filter that allows only a single side band component of the modulated wave to pass through; and a demodulating step of demodulating the modulated wave subjected to the filtering of the band-pass filter by the demodulating wave and outputting the demodulated wave as an output speech signal.

With the second structure of the pitch period equalizing method according to the present invention, in the first structure, the pitch period equalizing method further comprises: a pitch averaging step of calculating an average pitch frequency as the time-based average of the output pitch frequencies. The residual frequency calculating step calculates the difference between the output pitch frequency and the average pitch frequency, and sets the calculated difference as the residual frequency.

With the third structure of the pitch period equalizing method according to the present invention, in the first structure, the pitch period equalizing method further comprises: an input pitch detecting step of detecting a pitch frequency (hereinafter, referred to as an "input pitch frequency") of the input speech signal; and a pitch averaging step of calculating an average pitch frequency as the time-based average of the input pitch frequencies. The residual frequency calculating step calculates the difference between the output pitch frequency and the average pitch frequency, and sets the calculated difference as the residual frequency.

With the fourth structure of the pitch period equalizing method according to the present invention, the pitch period equalizing method equalizes a pitch period of voiced sound of an input speech signal (hereinafter, referred to as an "input speech signal"). The pitch period equalizing method comprises: an input pitch detecting step of detecting a pitch frequency (hereinafter, referred to as an "input pitch frequency") of the input speech signal; a frequency shifting step of inputting the input speech signal to a frequency shifter and obtaining an output signal (hereinafter, referred to as an "output speech signal") from the frequency shifter; and a residual frequency calculating step of calculating a residual frequency as the difference obtained by subtracting a predetermined reference frequency from the input pitch frequency. The frequency shifting step comprises: a frequency setting step of setting one of a frequency of a modulating wave used for modulation and a frequency of a demodulating wave used for demodulation to a predetermined basic carrier frequency, and setting the other frequency to a frequency obtained by subtracting the residual frequency calculated by the residual frequency calculating step from the basic carrier frequency; a modulating step of modulating an amplitude of the input speech signal by the modulating wave and generating a modulated wave; a band reducing step of performing filtering of the modulated wave by a band-pass filter that allows only a single side band component of the modulated wave; and a demodulating step of demodulating the modulated wave subjected to the filtering with the band-pass filter by the demodulating wave and outputting the demodulated wave as an output speech signal.

With the fifth structure of the pitch period equalizing method according to the present invention, in the fourth structure, the pitch period equalizing method further comprises: a pitch averaging step of calculating an average pitch frequency as the time-based average of the input pitch frequencies. The residual frequency calculating step calculates the difference between the input pitch frequency and the average pitch frequency, and sets the calculated difference as the residual frequency.

With the first structure of a speech coding method according to the present invention that encodes an input speech signal. The speech coding method comprises: a pitch period equalizing step of equalizing a pitch period of voiced sound of the speech signal with the pitch period equalizing method with any one of the first to fifth structures; an orthogonal transforming step of orthogonally transforming a speech signal (hereinafter, referred to as a "pitch-equalizing speech signal") the speech signal equalized by the pitch period equalizing step at a constant number of pitches, and generating transforming coefficient data of a subband; and a waveform coding step of encoding the transforming coefficient data.

With the second structure of the speech coding method according to the present invention, in the first structure, the speech coding method further comprises: a resampling step of performing resampling of the pitch-equalizing speech signal equalized by the pitch period equalizing step so that the number of samples at one pitch interval is constant.

According to the present invention, a program is executed by a computer to enable the computer to function as the pitch period equalizing apparatus with any one of the first to sixth structures.

Further, according to the present invention, a program is executed by a computer to enable the computer to function as the speech coding apparatus according to claim 7 or 8.

Furthermore, according to the present invention, a program is executed by a computer to enable the computer to function as the speech decoding apparatus according to the present invention.

ADVANTAGES

As mentioned above, with the pitch period equalizing apparatus according to the present invention, the information included in the input speech signal is separated into the information on the basic frequency at the pitch, the information on the fluctuation of the pitch frequency at each pitch, and the information on the waveform component superimposed to the pitch. The information is individually extracted as the reference frequency, the residual frequency, and the waveform within one pitch interval of the speech signal after the equalization.

As mentioned above, the speech can be searched with a small matching error and high precision by using only the information on the basic frequency at the pitch and the information on the waveform component superimposed to the pitch from the separated information.

Further, the information is separated and the individual information is encoded by the best coding method, thereby improving the coding efficiency of the input speech signal.

Therefore, it is possible to provide the pitch period equalizing apparatus that can perform the speech search with high precision and can also improve the coding efficiency of the input speech signal.

Further, with the speech coding apparatus according to the present invention, the information included in the input speech signal is separated by the pitch period equalizing apparatus into the information on the basic information at the pitch, the information on the fluctuation of pitch frequency every pitch, and the information on the waveform component superimposed to the pitch, and is individually obtained as the reference frequency, the residual frequency, and the waveform within one pitch interval of the pitch-equalizing speech signal. In addition, the pitch-equalizing speech signal is orthogonally transformed by a constant number of pitch intervals, thereby efficiently encoding the information on the waveform component superimposed to the pitch.

REFERENCE NUMERALS

Figure 1:
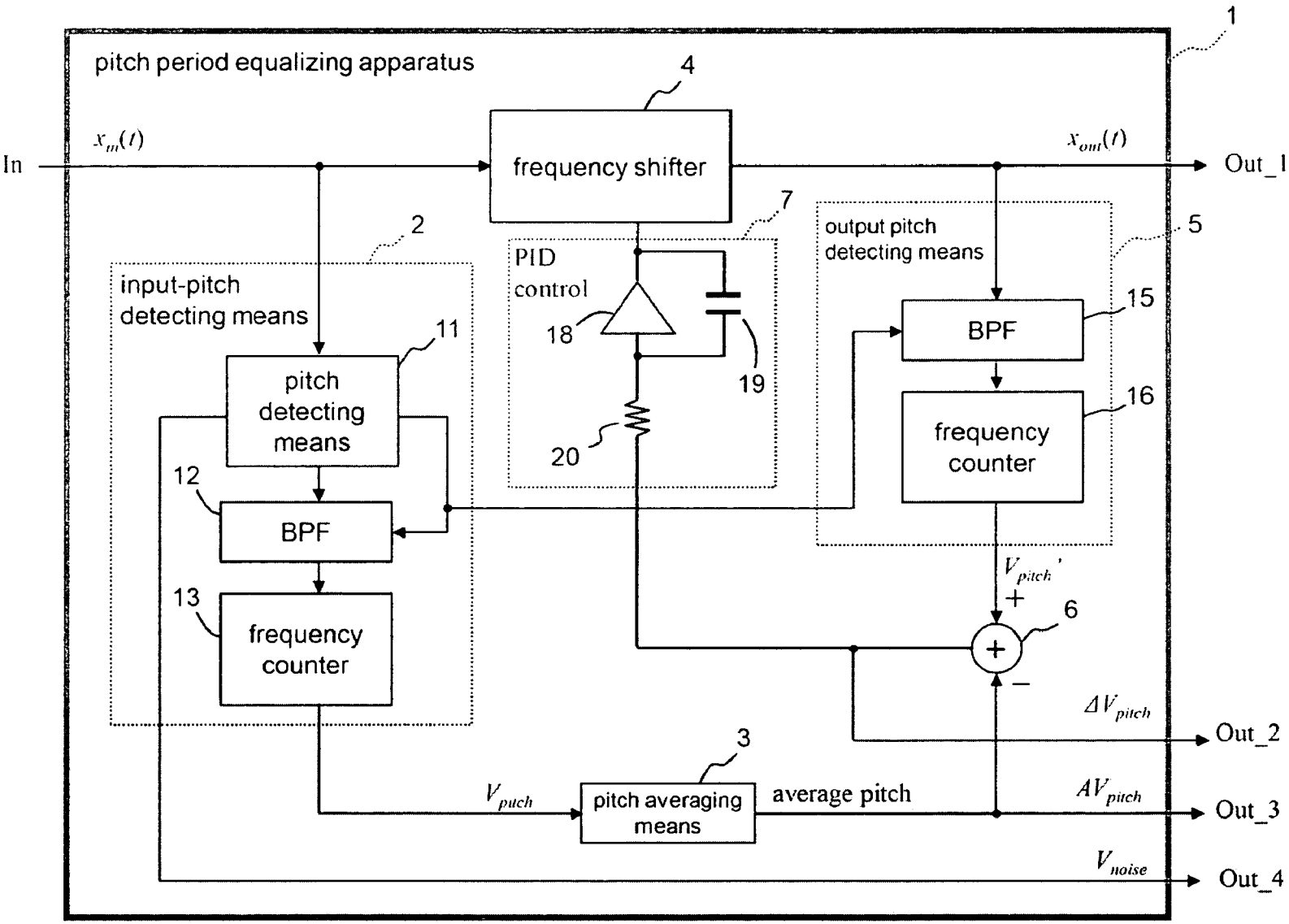
FIG. 1 is a block diagram showing the structure of a pitch period equalizing apparatus 1 according to the first embodiment of the present invention.

1, 1' pitch period equalizing apparatus
2 input-pitch detecting means
3 pitch averaging means
4 frequency shifter
5, 5" output pitch detecting means
6 residual calculating means
7 PID controller
11 pitch detecting means
12, 15 band-pass filter (BPF)
13 frequency counter
16 frequency counter
18 amplifier
19 condenser
20 resistor
21 oscillator
22 modulator
23 BPF
24 voltage control oscillator (VCO)
25 demodulator
30, 30' speech coding apparatus
31 resampler
32 analyzer
33 quantizer
34 pitch-equalizing waveform encoder
35 difference bit calculator
36, 36' pitch information encoder
41, 41' pitch period equalizing apparatus
42 reference-frequency generator
50, 50' speech decoding apparatus

51 pitch-equalizing waveform decoder
52 inverse quantizer
53 synthesizer
54, 54' pitch information decoder
55 pitch frequency detecting means
56 difference unit
57 adder
58 frequency shifter

BEST MODE FOR CARRYING OUT THE INVENTION

Hereinbelow, a description will be given of preferred embodiments of the present invention with reference to the drawings.

First Embodiment

FIG. 1 is a block diagram showing the structure of a pitch period equalizing apparatus 1 according to the first embodiment of the present invention. The pitch period equalizing apparatus 1 comprises: input-pitch detecting means 2; pitch averaging means 3; a frequency shifter 4; output pitch detecting means 5; residual calculating means 6; and a PID controller 7.

The input-pitch detecting means 2 detects a basic frequency at the pitch included in the speech signal, from an input speech signal $x_{in}(t)$ input from an input terminal In. Various methods for detecting the basic frequency at the pitch have been devised, and a typical one will be shown according to the first embodiment. The input-pitch detecting means 2 comprises: pitch detecting means 11; a band-pass filter (hereinafter, referred to as a "BPF") 12; and a frequency counter 13.

Figure 2:
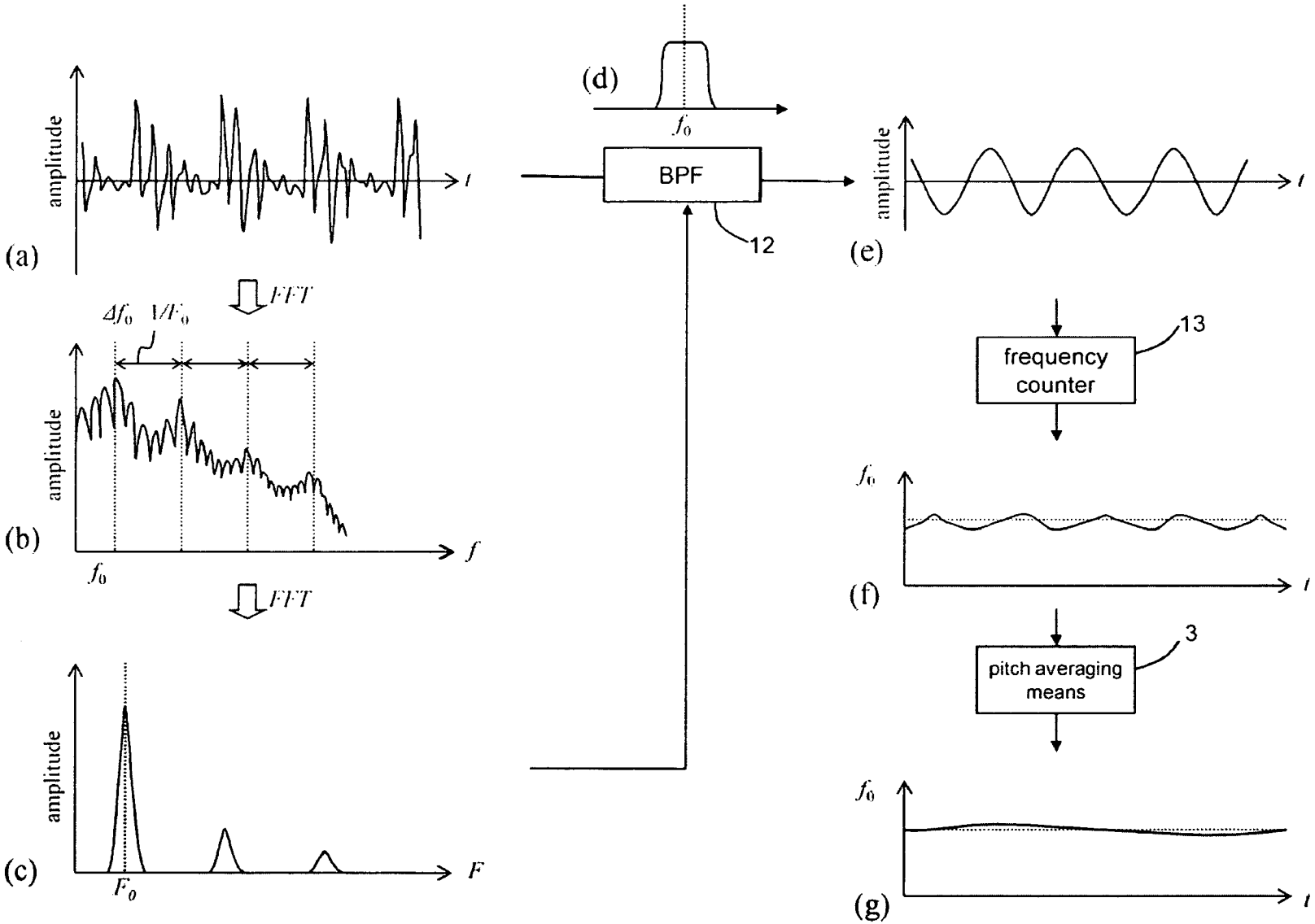
FIG. 2 is a schematically explanatory diagram of signal processing of pitch detecting means 11.

The pitch detecting means 11 detects a basic frequency $f_0$ at the pitch from the input speech signal $x_{in}(t)$. For example, the input speech signal $x_{in}(t)$ is assumed to be a waveform shown in FIG. 2(*a*). The pitch detecting means 11 performs Fast Fourier Transformation of this waveform, and derives a spectrum waveform X(f) shown in FIG. 2(*b*).

A speech waveform generally includes many frequency components as well as the pitch. Herein, the obtained spectrum waveform additionally has frequency components as well as the basic frequency at the pitch and a high-harmonic component at the pitch. Therefore, the basic frequency $f_0$ at the pitch cannot be generally extracted from the spectrum waveform X(f). Then, the pitch detecting means 11 performs again the Fourier transformation of the spectrum waveform X(f). As a consequence thereof, a spectrum waveform having a sharp peak at a point of $F_0=1/\Delta f_0$ as an inverse number of an interval $\Delta f_0$ of the harmonic wave at the pitch included in the spectrum waveform X(f) (refer to FIG. 2(*c*)). The pitch detecting means 11 detects the peak position $F_0$, thereby detecting the basic frequency $f_0=\Delta f_0=1/F_0$ at the pitch.

Figure 5:
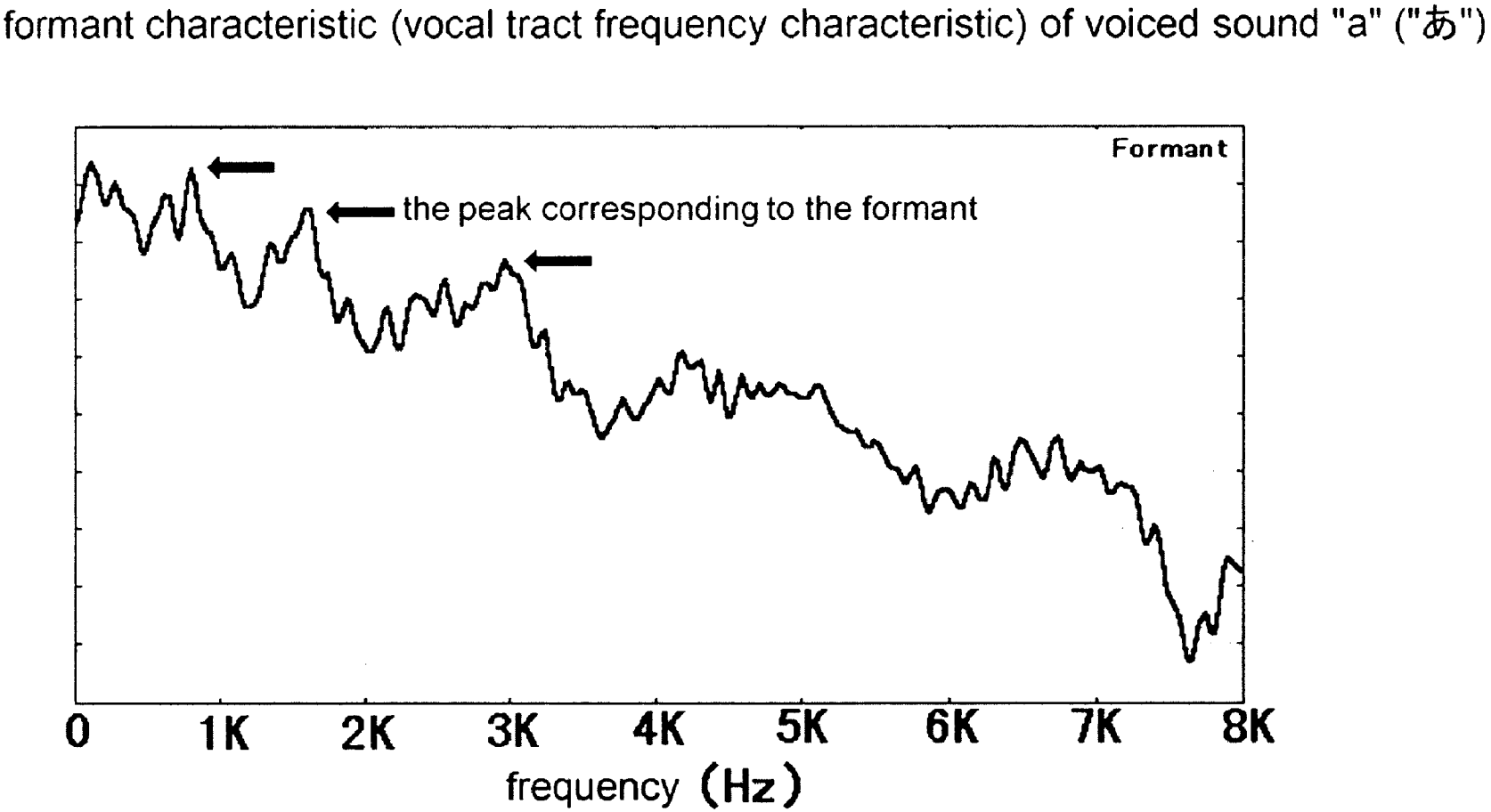
FIG. 5 is a diagram showing a formant characteristic of voiced sound "a" ("あ").
Figure 6:
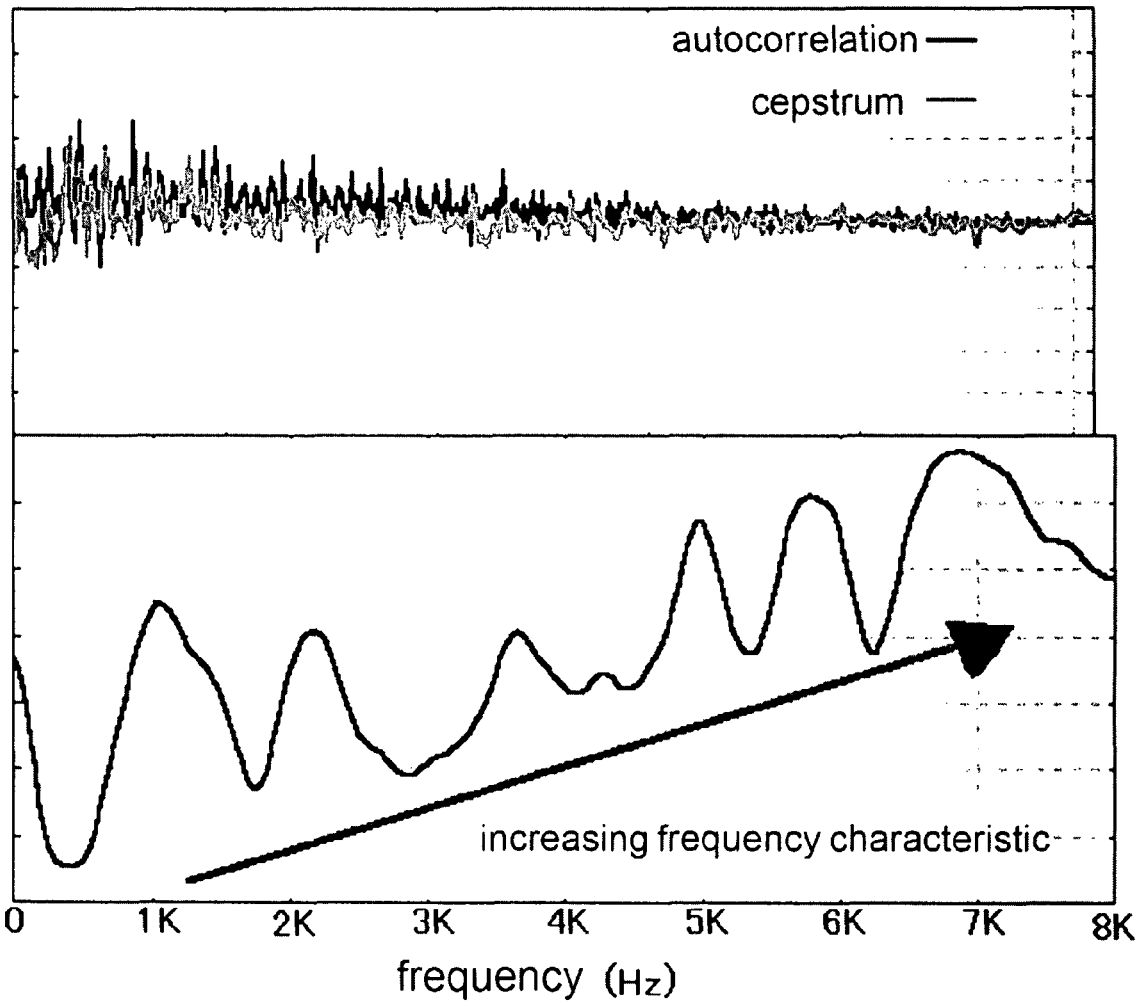
FIG. 6 is a diagram showing autocorrelation, a cepstrum waveform, and a frequency characteristic of unvoiced sound "s" ("す").

Further, the pitch detecting means 11 determines, from the spectrum waveform X(f), whether the input speech signal $x_{in}(t)$ is voiced sound or unvoiced sound. If it is determined that the input speech signal is the voiced sound, 0 is output as a noise flag signal $V_{noise}$. If it is determined that the input speech signal is the unvoiced sound, 1 is output as the noise flag signal $V_{noise}$. Incidentally, the determination as the voiced sound or the unvoiced sound is performed by detecting an inclination of the spectrum waveform X(f). FIG. 5 is a diagram showing a formant characteristic of voiced sound "a" ("あ") FIG. 6 is a diagram showing autocorrelation, a cepstrum waveform, and a frequency characteristic of unvoiced sound "s" ("す"). Referring to FIG. 5, the voiced sound shows a formant characteristic that, as a whole, the spectrum waveform X(f) is high on the low-frequency side and is smaller toward the high-frequency side. On the other hand, referring to FIG. 6, the unvoiced sound shows a frequency characteristic that the frequency is entirely increased toward the high-frequency side. Therefore, it can be determined, by detecting the entire inclination of the spectrum waveform X(f), whether the input speech signal $x_{in}(t)$ is voiced sound or unvoiced sound.

Incidentally, when the input speech signal $x_{in}(t)$ is the unvoiced sound, there are not any pitches. The basic frequency $f_0$ at the pitch, output by the pitch detecting means 11, therefore has an unmeaningless value.

As the BPF 12, an FIR (Finite Impulse Response) type filter having a narrow band capable of varying the central frequency is used. The BPF 12 sets the basic frequency $f_0$ at the pitch, detected by the pitch detecting means 11, as the central frequency of a pass band (refer to FIG. 2(*d*)). Further, the BPF 12 performs filtering of the input speech signal $x_{in}(t)$, and outputs a substantial sine waveform of the basic frequency $f_0$ at the pitch (refer to FIG. 2(*e*)).

The frequency counter 13 counts the number of zero-cross points per unit time of the substantially sine waveform, output by the BPF 12, thereby outputting the basic frequency $f_0$ at the pitch. The detected basic frequency $f_0$ at the pitch is output as an output signal (hereinafter, referred to as a "basic frequency signal") $V_{pitch}$ of the input-pitch detecting means 2 (refer to FIG. 2(*f*)).

The pitch averaging means 3 averages the basic frequency signal $V_{pitch}$ at the pitch, output by the pitch detecting means 11, and uses a general low-pass filter (hereinafter, referred to as an "LPF"). The pitch averaging means 3 smoothes the basic frequency signal $V_{pitch}$, thereby becoming a constant signal on the time base within the phoneme (refer to FIG. 2(*g*)). The smoothed basic frequency is used as a reference frequency $f_s$.

The frequency shifter 4 shifts the pitch frequency of the input speech signal $x_{in}(t)$ to be close to the reference frequency $f_0$, thereby equalizing the pitch period of the speech signal.

The output pitch detecting means 5 detects a basic frequency $f_0'$ at the pitch included in an output speech signal $x_{out}(t)$ output by the frequency shifter 4, from the output speech signal $x_{out}(t)$. The output pitch detecting means 5 can have basically the same structure as that of the input-pitch detecting means 2. According to the first embodiment, the output pitch detecting means 5 comprises a BPF 15 and a frequency counter 16.

As the BPF 15, an FIR filter having a narrow band capable of varying the central frequency is used. The BPF 15 sets, as the central frequency of the passage frequency, the basic frequency $f_0$ at the pitch detected by the pitch detecting means 11. Further, the BPF 15 performs filtering of the output speech signal $x_{out}(t)$ and outputs a substantial sine-waveform of the basic frequency $f_0'$ at the pitch. The frequency counter 16 counts the number of zero-cross points per unit time of the substantial sine waveform output by the BPF 15, thereby outputting the basic frequency $f_0'$ at the pitch. The detected basic frequency $f_0'$ at the pitch is output as an output signal $V_{pitch}'$ of the output pitch detecting means 5.

The residual calculating means 6 outputs a residual frequency $\Delta f_{pitch}$ obtained by subtracting the reference frequency $f_5$ output by the pitch averaging means 3 from the basic frequency $f_0'$ at the pitch output by the output pitch detecting means 5. The residual frequency $\Delta f_{pitch}$ is input to the frequency shifter 4 via the PID controller 7. The frequency shifter 4 shifts the pitch frequency of the input speech signal to be close to the reference frequency $f_0$ in proportional to the residual frequency $\Delta f_{pitch}$.

Incidentally, the PID controller 7 comprises an amplifier 18 and a resistor 20 that are serially connected to each other, and a condenser 19 that is connected to the amplifier 18 in parallel therewith. The PID controller 7 prevents the oscillation of a feedback loop comprising the frequency shifter 4, the output pitch detecting means 5, and the residual calculating means 6.

In FIG. 1, the PID controller 7 is shown as an analog circuit, and may be structured as a digital circuit.

Figure 3:
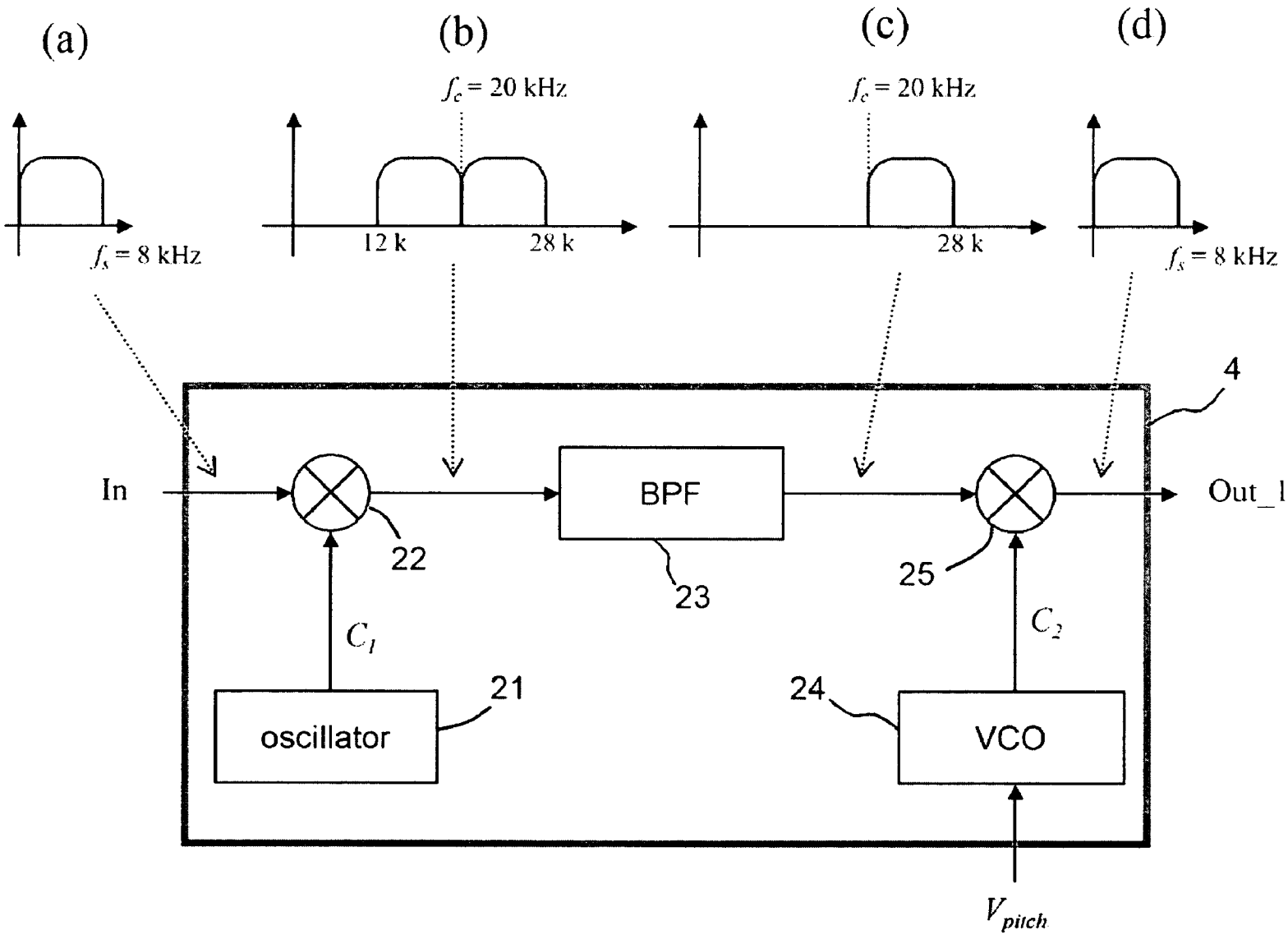
FIG. 3 is a diagram showing the internal structure of a frequency shifter 4.

FIG. 3 is a diagram showing the internal structure of the frequency shifter 4. The frequency shifter 4 comprises: an oscillator 21; a modulator 22; a BPF 23; a voltage control oscillator (hereinafter, referred to as a "VCO") 24; and a demodulator 25.

The oscillator 21 outputs a modulating carrier signal C1 of a constant frequency $f_0$ r modulating the amplitude of the input speech signal $x_{in}(t)$. In general, a band of the speech signal is approximately 8 kHz (refer to FIG. 3(*a*)). Therefore, a frequency (hereinafter, referred to as a "carrier frequency") of approximately 20 kHz is generally used as a frequency of the modulating carrier signal C1 generated by the oscillator 21.

The modulator 22 modulates the amplitude of the modulating carrier signal C1 output by the oscillator 21 by the input speech signal $x_{in}(t)$, and generates a modulated signal. The modulated signal has side bands (top side band and bottom side band) having the same band as the band of the speech signal on both sides thereof, with the carrier frequency as center (refer to FIG. 3(*b*)).

Only the top side band component of the modulated signal passes through the BPF 23. Accordingly, the modulated signal output by the BPF 23 becomes a single side band signal obtained by cutting-off only the bottom side band.

The VCO 24 outputs a signal (hereinafter, referred to as a "demodulating carrier signal") obtained by modulating the frequency of a signal having the same carrier frequency as that of the modulating carrier signal C1 output by the oscillator 21 with a signal (hereinafter, referred to as a "residual frequency signal") $\Delta V_{pitch}$ of the residual frequency $\Delta f_{pitch}$ input via the PID controller 7 from the residual calculating means 6. The frequency of the demodulating carrier signal is obtained by subtracting the residual frequency from the carrier frequency.

The demodulator 25 demodulates the modulated signal having only the top side band output by the BPF 23 with the demodulating carrier signal output by the VCO 24, and restores the speech signal (refer to FIG. 3(*d*)). In this case, the demodulating carrier signal is modulated by the residual frequency signal $\Delta V_{pitch}$. Therefore, upon demodulating the modulated signal, the deviation from the reference frequency $f_s$ of the pitch frequency in the input speech signal $x_{in}(t)$ is erased. That is, the pitch periods of the input speech signal $x_{in}(t)$ are equalized to a reference period $1/f_s$.

Figure 4:
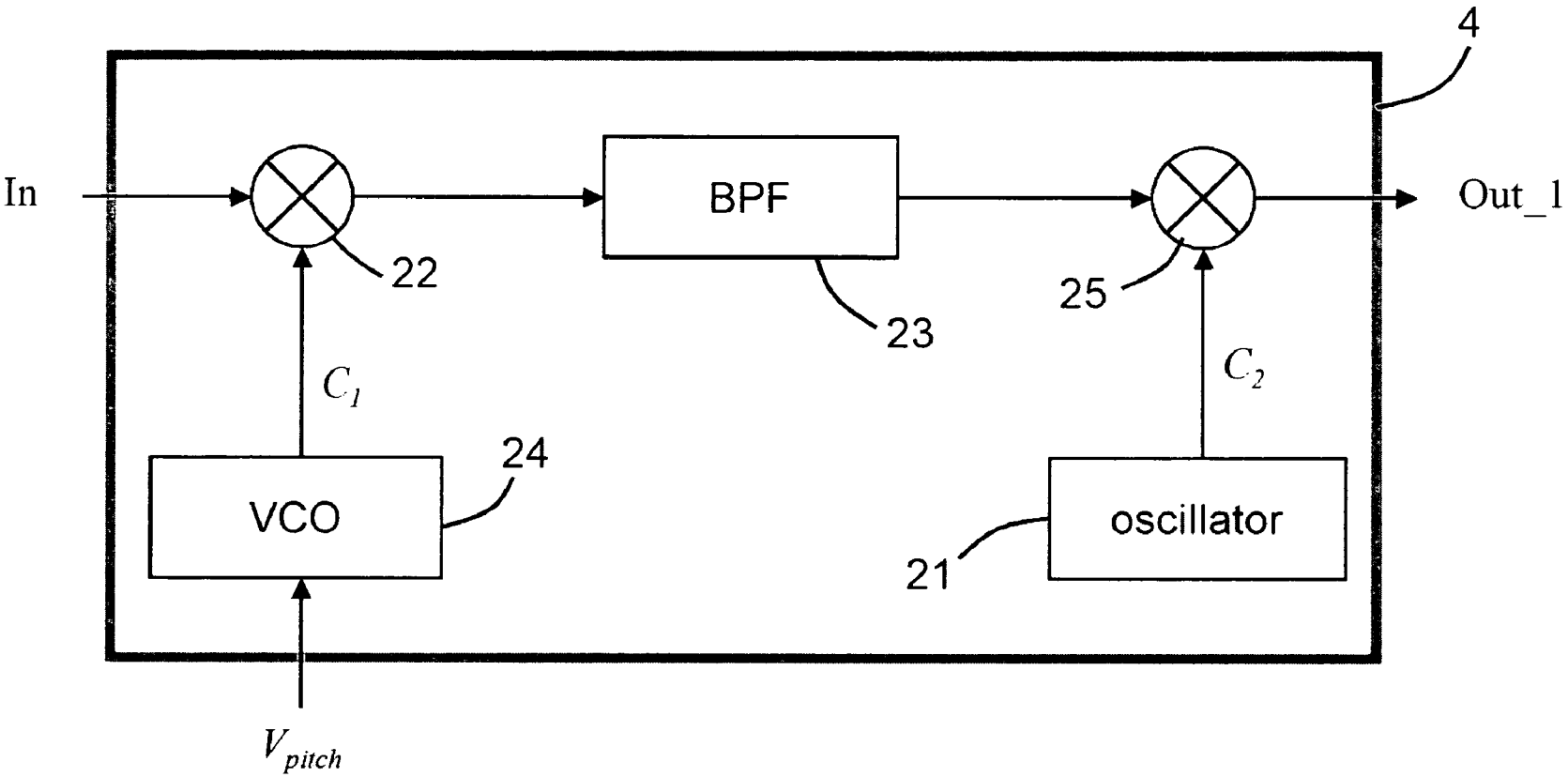
FIG. 4 is a diagram showing another example of the internal structure of the frequency shifter 4.

FIG. 4 is a diagram showing another example of the internal structure of the frequency shifter 4. Referring to FIG. 4, the oscillator 21 and the VCO 24 shown in FIG. 3 are replaced with each other. This structure can also equalize the pitch period of the input speech signal $x_{in}(t)$ to the reference period $1/f_s$, similarly to the case shown in FIG. 3.

Hereinbelow, a description will be given of the operation of the pitch period equalizing apparatus 1 having the above-mentioned structure according to the first embodiment.

First, the input speech signal $x_{in}(t)$ is input from the input terminal In. Then, the input-pitch detecting means 2 determines whether the input speech signal $x_{in}(t)$ is voiced sound or unvoiced sound, and outputs a noise flag signal $V_{noise}$ to an output terminal OUT_4. Further, the input-pitch detecting means 2 detects the pitch frequency from the input speech signal $x_{in}(t)$, and outputs the basic frequency signal $V_{pitch}$ to the pitch averaging means 3. The pitch averaging means 3 averages the basic frequency signal $V_{pitch}$ (in this case, a weighted average because of using the LPF), and the resultant signal as a reference frequency signal $\Delta V_{pitch}$. The reference frequency signal $\Delta V_{pitch}$ is output from an output terminal OUT_3 and is input to the residual calculating means 6.

The frequency shifter 4 shifts the frequency of the input speech signal $x_{in}(t)$ and outputs the resultant frequency to an output terminal Out_1, as the output speech signal $x_{out}(t)$. In the initial state, the residual frequency signal $\Delta V_{pitch}$ is 0 (reset state), the frequency shifter 4 outputs the input speech signal $x_{in}(t)$, as the output speech signal $x_{out}(t)$, to the output terminal Out_1.

Subsequently, the output pitch detecting means 5 detects the pitch frequency $f_0'$ of the output speech signal output by the frequency shifter 4. The detected pitch frequency $f_0'$ is input to the residual calculating means 6, as a pitch frequency signal $V_{pitch}'$.

The residual calculating means 6 generates the residual frequency signal $\Delta V_{pitch}$ by subtracting the reference frequency signal $\Delta V_{pitch}$ from the pitch frequency signal $V_{pitch}'$. The residual frequency signal $\Delta V_{pitch}$ is output to an output terminal Out_2 and is input to the frequency shifter 4 via the PID controller 7.

The frequency shifter 4 sets the amount of shift of the frequency in proportional to the residual frequency signal $\Delta V_{pitch}$ input via the PID controller 7. In this case, if the residual frequency signal $\Delta V_{pitch}$ is a positive value, the amount of shift of the frequency is set to reduce the frequency by the amount of frequency proportional to the residual frequency signal $\Delta V_{pitch}$. If the residual frequency signal $\Delta V_{pitch}$ is a negative value, the amount of shift is set to increase the frequency by the amount of frequency proportional to the residual frequency signal $\Delta V_{pitch}$.

This feedback control always maintains the pitch period of the input speech signal $x_{in}(t)$ to the reference period $1/f_s$, and the pitch periods of the output speech signal $x_{out}(t)$ are equalized.

As mentioned above, with the pitch period equalizing apparatus 1 according to the first embodiment, information included in the input speech signal $x_{in}(t)$ is separated as follows.

(a) Information indicating the voiced sound or the unvoiced sound;

(b) Information indicating the speech waveform at one pitch interval;

(c) Information of the reference pitch frequency; and (d) Residual frequency information indicating the amount of deviation from the reference pitch frequency of the pitch frequency at the pitch interval. The information (a) to (d) is individually output as the noise flag signal $V_{noise}$, the output speech signal $x_{out}(t)$ obtained by equalizing the pitch period to the reference period $1/f_s$ (reciprocal of a weighted average of the past pitch frequencies of the input speech signal), the reference frequency signal $\Delta V_{pitch}$, and the residual frequency signal $\Delta V_{pitch}$.

The output speech signal $x_{out}(t)$ is a toneless, flat, and mechanical speech signal obtained by removing the jitter component and the changing component of the pitch frequency that changes depending on the difference between the sexes, the individual difference, the phoneme, the feeling, and conversation contents. Therefore, the output speech signal $x_{out}(t)$ of the voiced sound can obtain substantially the same waveform, irrespective of the difference between the sexes, the individual difference, the phoneme, the feeling, and the conversation contents. Therefore, the output speech signal $x_{out}(t)$ is compared, thereby precisely performing the matching of the voiced sound. That is, the pitch period equalizing apparatus 1 is applied to the speech search apparatus, thereby improving the search precision.

Further, the pitch periods of the output speech signal $x_{out}(t)$ of the voiced sound are equalized to the reference period $1/f_s$. Therefore, the subband coding is performed at a constant number of the pitch intervals, and a frequency spectrum $X_{out}(f)$ of the output speech signal $x_{out}(t)$ is aggregated to the subband component of the high-harmonic component of the reference frequency. The speech has a large waveform correlation between the pitches and the time-based change in spectrum intensity of the subband is gradual. As a consequence, the subband component is encoded and another noise component is omitted, thereby enabling high-efficient coding. Further, the reference frequency signal $\Delta V_{pitch}$ and the residual frequency signal $\Delta V_{pitch}$ do not fluctuate only within a narrow range in the same phoneme due to the speech property, thereby enabling high-efficient coding. Therefore, the voiced sound component of the input speech signal $x_{in}(t)$ can be encoded with high efficiency as a whole.

Second Embodiment

Figure 7:
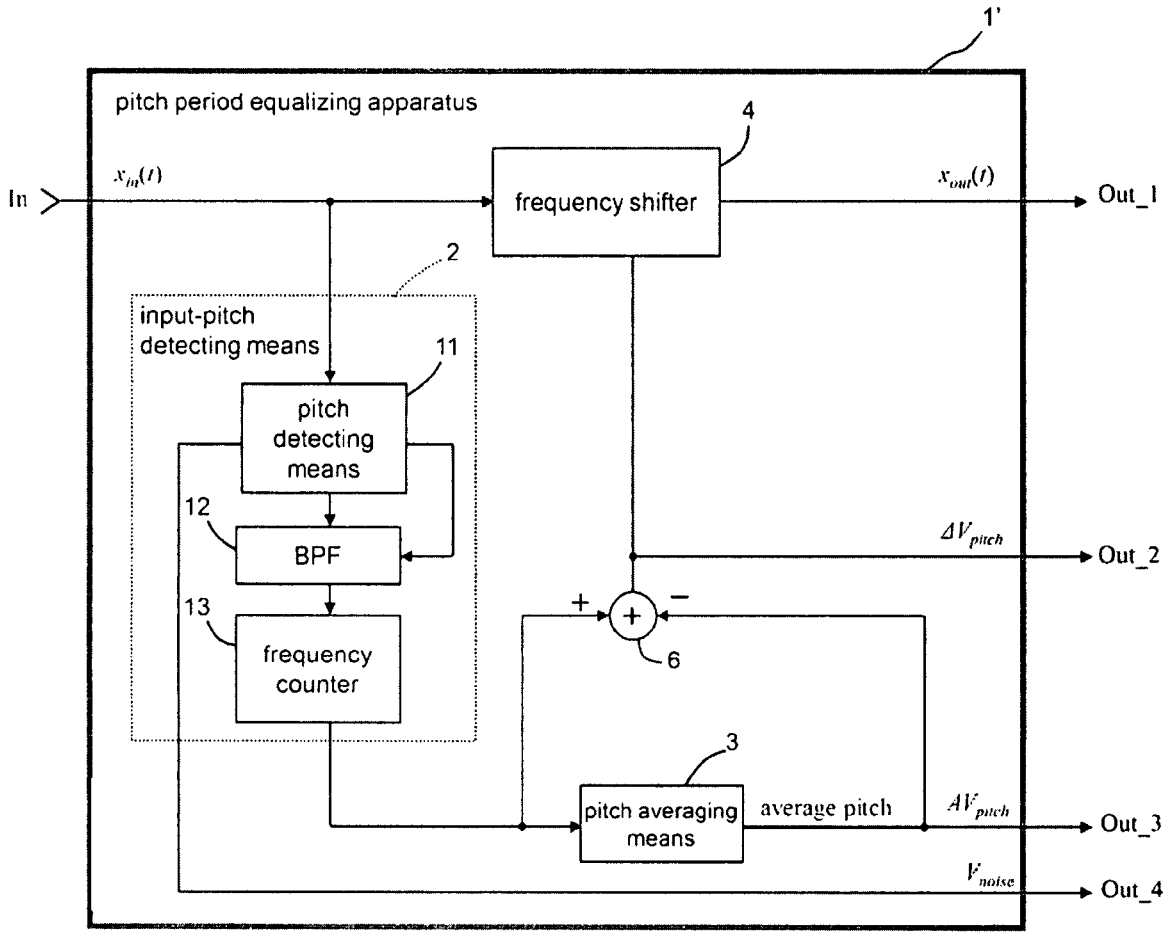
FIG. 7 is a diagram showing the structure of a pitch period equalizing apparatus 1' according to the second embodiment of the present invention.

FIG. 7 is a diagram showing the structure of a pitch period equalizing apparatus 1' according to the second embodiment of the present invention. The pitch period equalizing apparatus 1 according to the first embodiment equalizes the pitch periods by the feedback control of the residual frequency $\Delta f_{pitch}$. However, the pitch period equalizing apparatus 1' according to the second embodiment equalizes the pitch periods by the feed forward control of the residual frequency $\Delta f_{pitch}$.

Referring to FIG. 7, the input-pitch detecting means 2, the pitch averaging means 3, the frequency shifter 4, residual calculating means 6, the pitch detecting means 11, the BPF 12, and the frequency counter 13 are similar to those shown in FIG. 1, and are therefore designated by the same reference numerals, and a description is omitted.

With the pitch period equalizing apparatus 1', the residual calculating means 6 generates the residual frequency signal $\Delta V_{pitch}$ by subtracting the reference frequency signal $\Delta V_{pitch}$ from the basic frequency signal $V_{pitch}$ output by the input-pitch detecting means 2. Further, since the feed forward control is used, a countermeasure for the oscillation is not required and the PID controller 7 is therefore omitted. Furthermore, since the feed forward control is used, the output pitch detecting means 5 is also omitted. Other structures are similar to those according to the first embodiment.

With this structure, similarly to the case according to the first embodiment, the input speech signal $x_{in}(t)$ can be separated into the noise flag signal $V_{noise}$, the output speech signal $x_{out}(t)$, the reference frequency signal $\Delta V_{pitch}$, and the residual frequency signal $\Delta V_{pitch}$.

Third Embodiment

Figure 8:
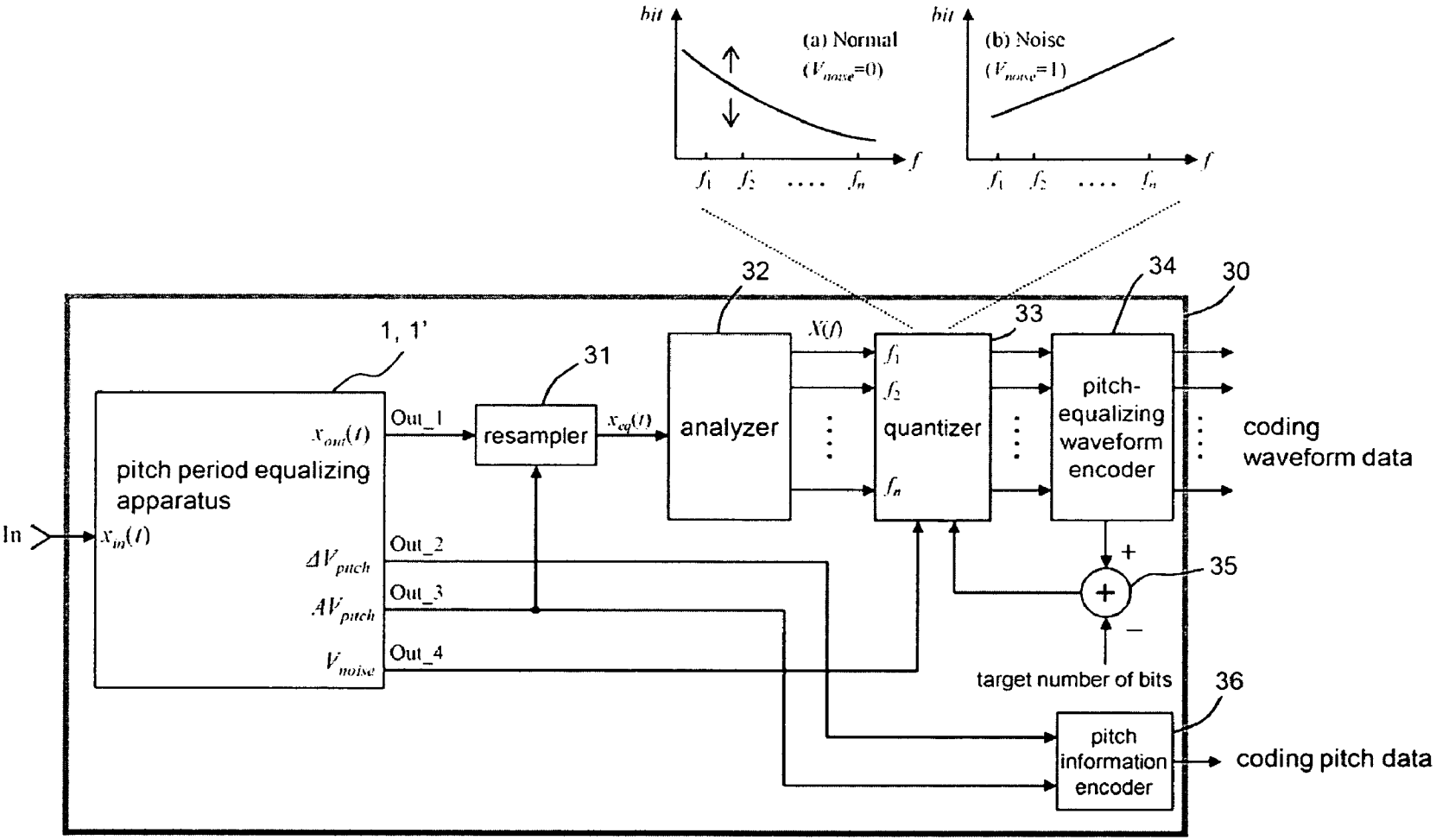
FIG. 8 is a diagram showing the structure of a speech coding apparatus 30 according to the third embodiment of the present invention.

FIG. 8 is a diagram showing the structure of a speech coding apparatus 30 according to the third embodiment of the present invention. The speech coding apparatus 30 comprises: the pitch period equalizing apparatuses 1 and 1'; a resampler 31; an analyzer 32; a quantizer 33; a pitch-equalizing waveform encoder 34; a difference bit calculator 35; and a pitch information encoder 36.

The pitch period equalizing apparatuses 1 and 1' are the pitch period equalizing apparatuses according to the first and second embodiments. The resampler 31 performs the resampling of the pitch interval of the output speech signal $x_{out}(t)$ output from the output terminal Out_1 of the pitch period equalizing apparatuses 1 and 1' for the purpose of obtaining the same number of samples, and the resultant signal is output as an equal-number-of-samples speech signal $x_{eq}(t)$.

The analyzer 32 performs Modified Discrete Cosine Transform (hereinafter, referred to as "MDCT") of the equal-number-of-samples speech signal $x_{eq}(t)$ with a constant number of the pitch intervals, thereby generating a frequency spectrum signal $X(f)=\{X(f_1), X(f_2), \ldots, X(f_n)\}$ corresponding to n subband components. The quantizer 33 quantizes the frequency spectrum signal X(f) by a predetermined quantization curve. The pitch-equalizing waveform encoder 34 encodes the frequency spectrum signal X(f) output by the quantizer 33, and outputs the encoded signal as coding waveform data. This coding uses entropy coding such as Huffman coding and arithmetic coding.

The difference bit calculator 35 subtracts a target number of bits from the amount of codes of the coding waveform data output by the pitch-equalizing waveform encoder 34 and the difference (hereinafter, referred to as a "number of difference bits"). The quantizer 33 moves parallel the quantization curve by the number of difference bits, and adjusts the amount of codes of the coding waveform data to be within a range of the target number of bits.

The pitch information encoder 36 encodes the residual frequency signal $\Delta V_{pitch}$ and the reference frequency signal $\Delta V_{pitch}$ output by the pitch period equalizing apparatuses 1 and 1', and outputs the encoded signals as coding pitch data. This coding uses entropy coding such as Huffman coding and arithmetic coding.

Hereinbelow, a description will be given of the operation of the speech coding apparatus 30 with the above-mentioned structure according to the third embodiment.

First, the input speech signal $x_{in}(t)$ is input from the input terminal In. The pitch period equalizing apparatuses 1 and 1' separate the waveform information of the input speech signal $x_{in}(t)$ as described above according to the first embodiment into the following information.

(a) Information indicating the voiced sound or the unvoiced sound;

(b) Information indicating the speech waveform at one pitch interval;

(c) Information of the reference pitch frequency; and (d) Residual frequency information indicating the amount of deviation from the reference pitch frequency of the pitch frequency at the pitch interval. The information is individually output as the noise flag signal $V_{noise}$, the output speech signal $x_{out}(t)$, the reference frequency signal $\Delta V_{pitch}$, and the residual frequency signal $\Delta V_{pitch}$. The noise flag signal $V_{noise}$ is output from the output terminal Out_4, the output speech signal $x_{out}(t)$ is output from the output terminal Out_1, the reference frequency signal $\Delta V_{pitch}$ is output from the output terminal Out_3, and the residual frequency signal $\Delta V_{pitch}$ is output from the output terminal Out_2.

Subsequently, the resampler 31 divides the reference frequency signal $\Delta V_{pitch}$ at each pitch interval by a constant number n of resamples, thereby calculating the resampling period. Then, the output speech signal $x_{out}(t)$ is resampled by the resampling period, and is output as the equal-number-of-samples speech signal $x_{eq}(t)$. As a consequence, the number of samples of the output speech signal $x_{out}(t)$ at one pitch interval has a constant value.

Subsequently, the analyzer 32 segments the equal-number-of-samples speech signal $x_{eq}(t)$ into subframes corresponding to a constant number of the pitch intervals. Further, the MDCT is performed every subframe, thereby generating the frequency spectrum signal X(f).

Herein, a length of one subframe is an integer multiple of one pitch period. According to the third embodiment, the length of the subframe corresponds to one pitch period (n samples). Therefore, n frequency spectrum signals $\{X(f_1), X(f_2), \ldots, X(f_n)\}$ are output. A frequency $f_1$ is a first higher harmonic wave of the reference frequency, a frequency $f_2$ is a second higher harmonic wave of the reference frequency, and a frequency $f_n$ is an n-th higher harmonic wave of the reference frequency.

As mentioned above, the subbands are encoded by the division into the subframes of the integer multiple of one pitch period and by the orthogonal transformation of the subframes, thereby aggregating the frequency spectrum signal of the speech waveform data to the reference frequency having a higher harmonic wave. Further, the waveforms at the continuous pitch intervals within the same phoneme are similar due to the speech property. Therefore, the spectra of the high-harmonic component of the reference frequency are similar between the adjacent subframes. Therefore, the coding efficiency is improved.

Figure 10:
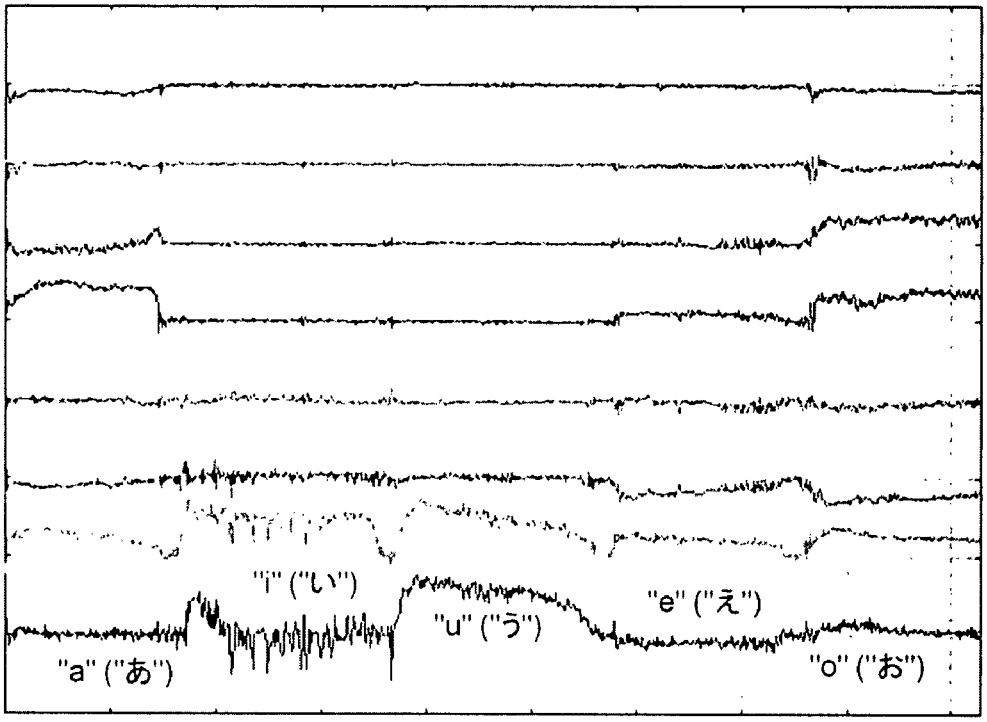
FIG. 10 is a diagram showing an example of the time-based change in spectrum intensity of subbands.
Figure 10:
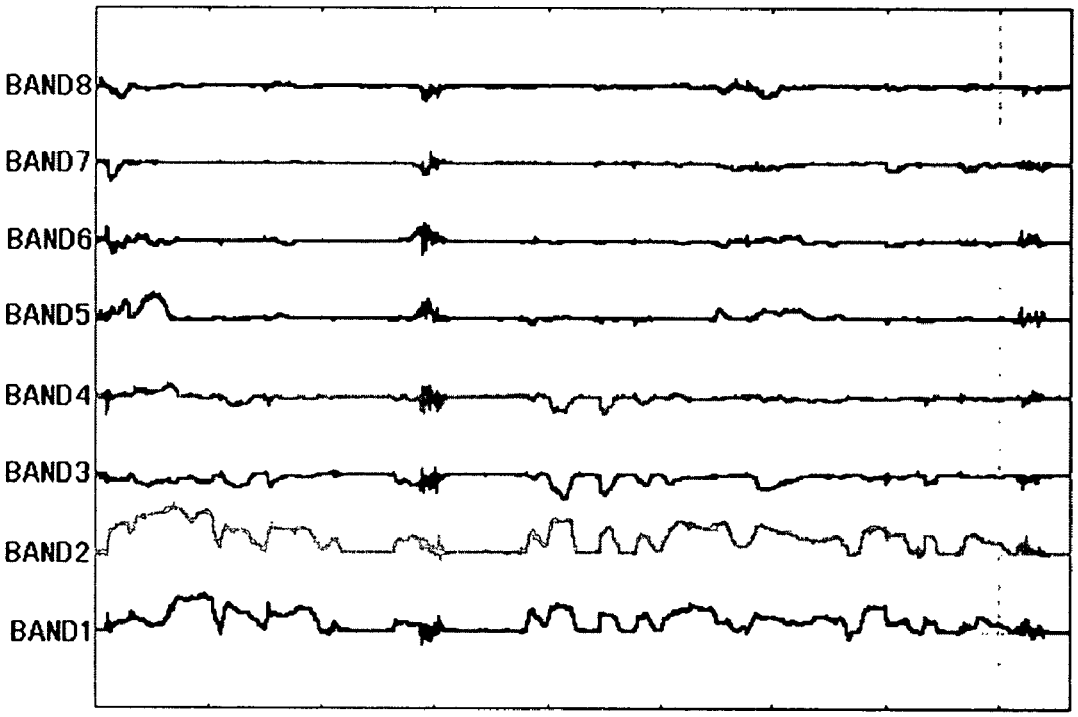

FIG. 10 shows an example of the time-based change in spectrum intensity of the subband. FIG. 10(*a*) shows the time-based change in spectrum intensity of the subband of a vowel of the Japanese language. From the bottom, the first higher harmonic wave, the second higher harmonic wave, the eighth higher harmonic wave of the reference frequency are sequentially shown. FIG. 10(*b*) shows the time-based change in spectrum intensity of the subband of a speech signal "arayuru genjitsu wo subete jibunnohoue nejimagetanoda". In this case, from the bottom, the first higher harmonic wave, the second higher harmonic wave, . . . , the eighth higher harmonic wave of the reference frequency are also sequentially shown. FIGS. 10(*a*) and 10(*b*) are diagrams with the abscissa as the time and the ordinate as the spectrum intensity. As will be understood from those, at the pitch interval of the voiced sound, the spectrum intensity of the subband indicates flat property (like DC). Therefore, in the coding, the coding efficiency is obviously high.

Subsequently, the quantizer 33 quantizes the frequency spectrum signal X(f). Herein, the quantizer 33 switches the quantization curve with reference to the noise flag signal $V_{noise}$, depending on the case in which the noise flag signal $V_{noise}$ is 0 (voiced sound) and the case in which the noise flag signal $V_{noise}$ is 1 (unvoiced sound).

When the noise flag signal $V_{noise}$ is 0 (voiced sound), referring to FIG. 8(*a*), the quantization curve reduces the number of quantized bits as the frequency is higher. This corresponds to the fact that the frequency characteristic of the voiced sound is high within the low-frequency band and is reduced as it is close to the high-frequency band, as shown in FIG. 5.

When the noise flag signal $V_{noise}$ is 1 (unvoiced sound), with respect to the quantization curve, the number of quantized bits is increased as the frequency is higher, as shown in FIG. 8(*b*). This corresponds to the fact that the frequency characteristic of the unvoiced sound is increased as it is close to the high frequency band, as shown in FIG. 6.

The switching of the quantization curve selects the quantization curve, depending on the voiced sound or the unvoiced sound.

Figure 9:
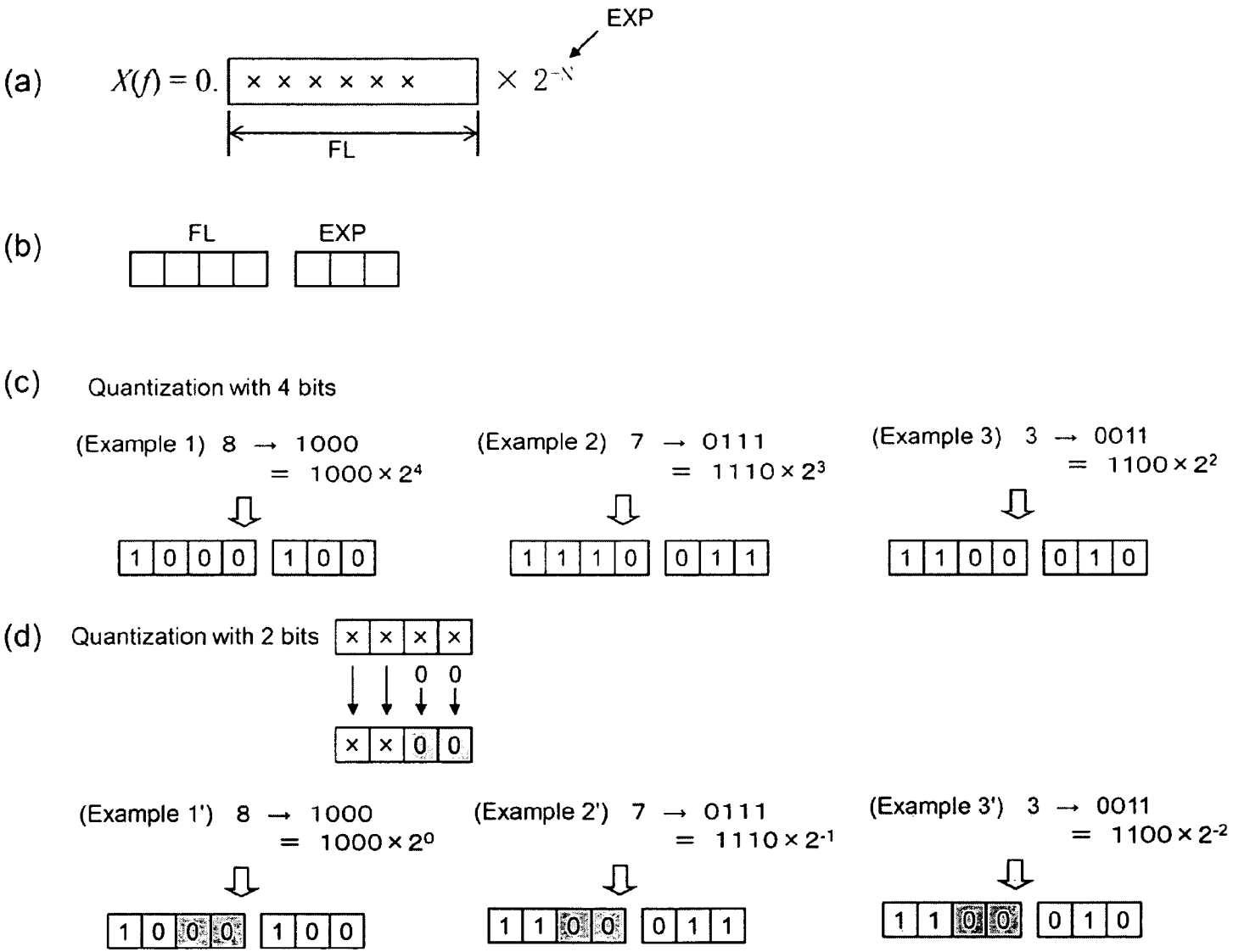
FIG. 9 is an explanatory diagram of the number of quantized bits.

Complementarily, the number of quantized bits will be described. Quantization data format of the quantizer 33 is expressed by a real-number part (FL) of a fractional portion and an exponential part (EXP) indicating the square, as shown in FIGS. 9(*a*) and (*b*). However, in the case of expressing a number other than 0, the exponential part (EXP) is adjusted so that the first one bit in the real-number part (FL) is necessarily to 1.

For example, when the real-number part (FL) includes 4 bits and the exponential part (EXP) includes 2 bits, the cases of the quantization with 4 bits and the quantization with 2 bits are as follows (refer to FIGS. 9(*c*) and (*d*)).

(1) Quantization with 4 Bits

EXAMPLE 1

In the case of $X(f)=8=[1000]_2$ (where $[\ ]_2$ denotes binary number expression), $FL=[1000]_2$, $EXP=[100]_2$

EXAMPLE 2

In the case of $X(f)=7=[0100]_2$, $FL=[1110]_2$, $EXP=[011]_2$

EXAMPLE 3

In the case of $X(f)=3=[1000]_2$, $FL=[1100]_2$, $EXP=[010]_2$ (2) Quantization with 2 Bits

EXAMPLE 1

In the case of $X(f)=8=[1000]_2$, $FL=[1000]_2$, $EXP=[100]_2$

EXAMPLE 2

In the case of $X(f)=7=[0100]_2$, $FL=[1100]_2$, $EXP=[011]_2$

EXAMPLE 3

In the case of $X(f)=3=[1000]_2$, $FL=[1100]_2$, $EXP=[010]_2$

That is, in the case of quantization with n bits, n bits remain from the head of the real-number part (FL), and other bits are set to be 0 (refer to FIG. 9(*d*)).

Subsequently, the pitch-equalizing waveform encoder 34 encodes the quantized frequency spectrum signal X(f) output by the quantizer 33 by the entropy coding, and outputs the coding waveform data. Further, the pitch-equalizing waveform encoder 34 outputs the amount of codes (the number of bits) of the coding waveform data to the difference bit calculator 35. The difference bit calculator 35 subtracts a predetermined target number of bits from the amount of codes of the coding waveform data, and outputs the number of difference bits. The quantizer 33 moves parallel up and down the quantization curve of the voiced sound in accordance with the number of difference bits.

For example, it is assumed that a quantization curve to $\{f_1, f_2, f_3, f_4, f_5, f_6\}$ is $\{6, 5, 4, 3, 2, 1\}$ and 2 is input as the number of difference bits. Then, the quantizer 33 moves parallel down the quantization curve by 2. As a consequence, the quantization curve is $\{4, 3, 2, 1, 0, 0\}$. Further, when −2 is input as the number of difference bits, the quantizer 33 moves parallel up the quantization curve by 2. As a consequence, the quantization curve is $\{8, 7, 6, 5, 4, 3\}$.

As mentioned above, the amount of code of the coding waveform data in the subframe is adjusted to approximately the target number of bits by changing up/down the quantization curve of the voiced sound.

In parallel with this, the pitch information encoder 36 encodes the reference frequency signal $\Delta V_{pitch}$ and the residual frequency signal $\Delta V_{pitch}$.

As mentioned above, with the speech coding apparatus 30 according to the third embodiment, the pitch periods of the voiced sound are equalized and the equalized period is divided into the subframes having the length of an integer-multiple of one pitch period. The subframes are orthogonally transformed and are encoded to subbands. Accordingly, the frequency spectra of the subframe with small time-based change are obtained on time series. Therefore, the coding is possible with high coding efficiency.

Fourth Embodiment

Figure 11:
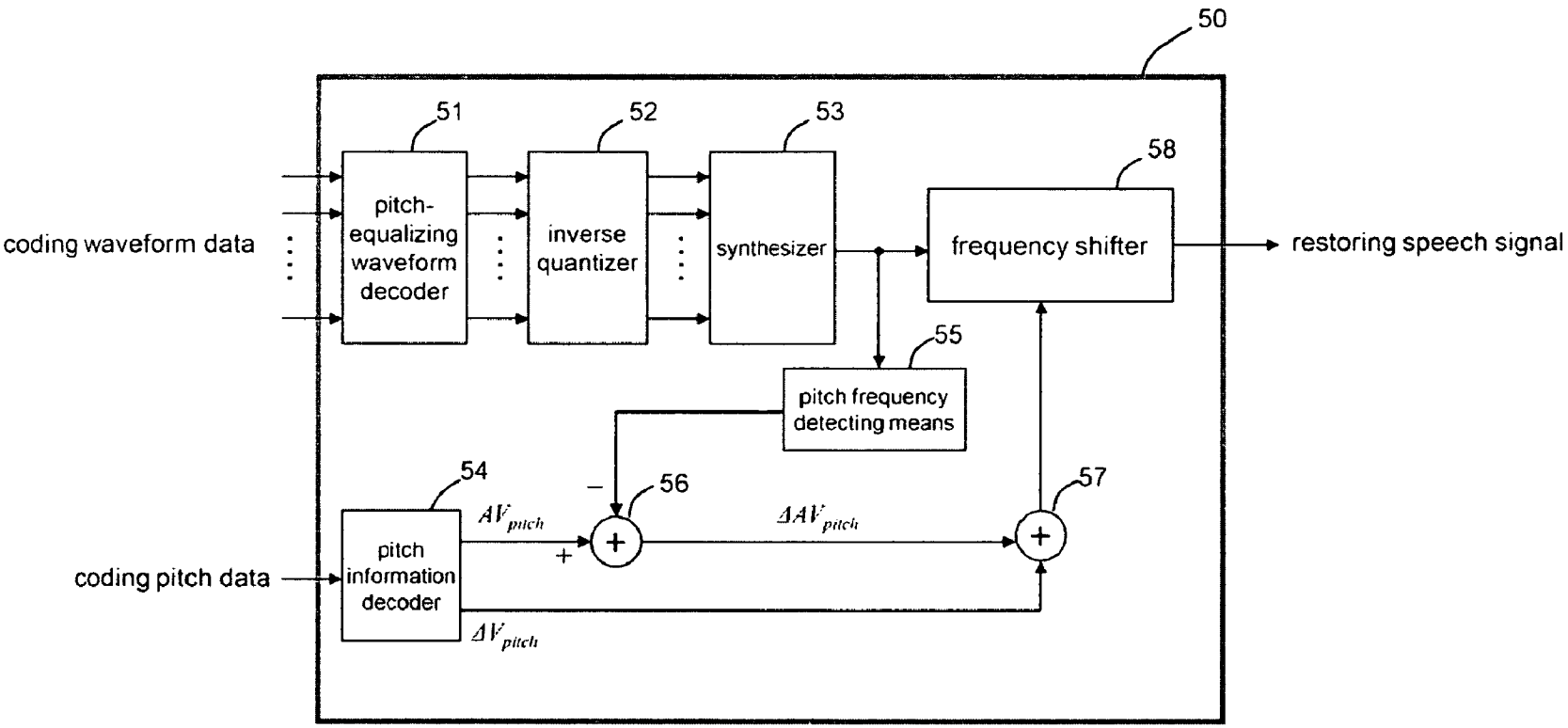
FIG. 11 is a block diagram showing the structure of a speech decoding apparatus 50 according to the fourth embodiment of the present invention.

FIG. 11 is a block diagram showing the structure of a speech decoding apparatus 50 according to the fourth embodiment of the present invention. The speech decoding apparatus 50 decodes the speech signal encoded by the speech coding apparatus 30 according to the third embodiment. The speech decoding apparatus 50 comprises: a pitch-equalizing waveform decoder 51; an inverse quantizer 52; a synthesizer 53; a pitch information decoder 54; pitch frequency detecting means 55; a difference unit 56; an adder 57; and a frequency shifter 58.

The coding waveform data and coding pitch data are input to the speech decoding apparatus 50. The coding waveform data is output from the pitch-equalizing waveform encoder 34 shown in FIG. 9. The coding pitch data is output from the pitch information encoder 36 shown in FIG. 9.

The pitch-equalizing waveform decoder 51 decodes the coding waveform data and restores the frequency spectrum signal of the subband after the quantization (hereinafter, referred to as a "quantized frequency spectrum signal"). The inverse quantizer 52 inversely quantizes the quantized frequency spectrum signal, and restores the frequency spectrum signal $X(f)=\{X(f_1), X(f_2), \ldots, X(f_n)\}$ of n subbands.

The synthesizer 53 performs Inverse Modified Discrete Cosine Transform (hereinafter, referred to as "IMDCT") of the frequency spectrum signal X(f), and generates time-series data of one pitch interval (hereinafter, referred to as an "equalized speech signal") $x_{eq}(t)$. The pitch frequency detecting means 55 detects the pitch frequency of the equalized speech signal $x_{eq}(t)$, and outputs an equalized pitch frequency signal $V_{eq}$.

The pitch information decoder 54 decodes the coding pitch data, thereby restoring the reference frequency signal $\Delta V_{pitch}$ and the residual frequency signal $\Delta V_{pitch}$. The difference unit 56 outputs, as the reference frequency changed signal $\Delta AV_{pitch}$, the difference obtained by subtracting the equalized pitch frequency signal $V_{eq}$ from the reference frequency signal $\Delta AV_{pitch}$. The adder 57 adds the residual frequency signal $\Delta V_{pitch}$ and the reference frequency changed signal $\Delta AV_{pitch}$ and outputs the addition result as a "corrected residual frequency signal $\Delta V_{pitch}$".

The frequency shifter 58 has the same structure as that of the frequency shifter 4 shown in FIG. 3 or 4. In this case, the equalized speech signal $x_{eq}(t)$ is input to the input terminal In, and the corrected residual frequency signal $\Delta V_{pitch}''$ is input to the VCO 24. The VCO 24 outputs a signal (hereinafter, referred to as a "demodulating carrier signal") obtained by modulating the frequency of a signal having the same carrier frequency as that of the modulating carrier signal C1 output by the oscillator 21 by a signal by the corrected residual frequency signal $\Delta V_{pitch}''$ input from the adder 57. In this case, the frequency of the demodulating carrier signal is obtained by adding the residual frequency to the carrier frequency.

Thus, the frequency shifter 58 adds the fluctuation component to the pitch period of the pitch interval of the equalized speech signal $x_{eq}(t)$, thereby restoring the speech signal $x_{res}(t)$.

Fifth Embodiment

Figure 12:
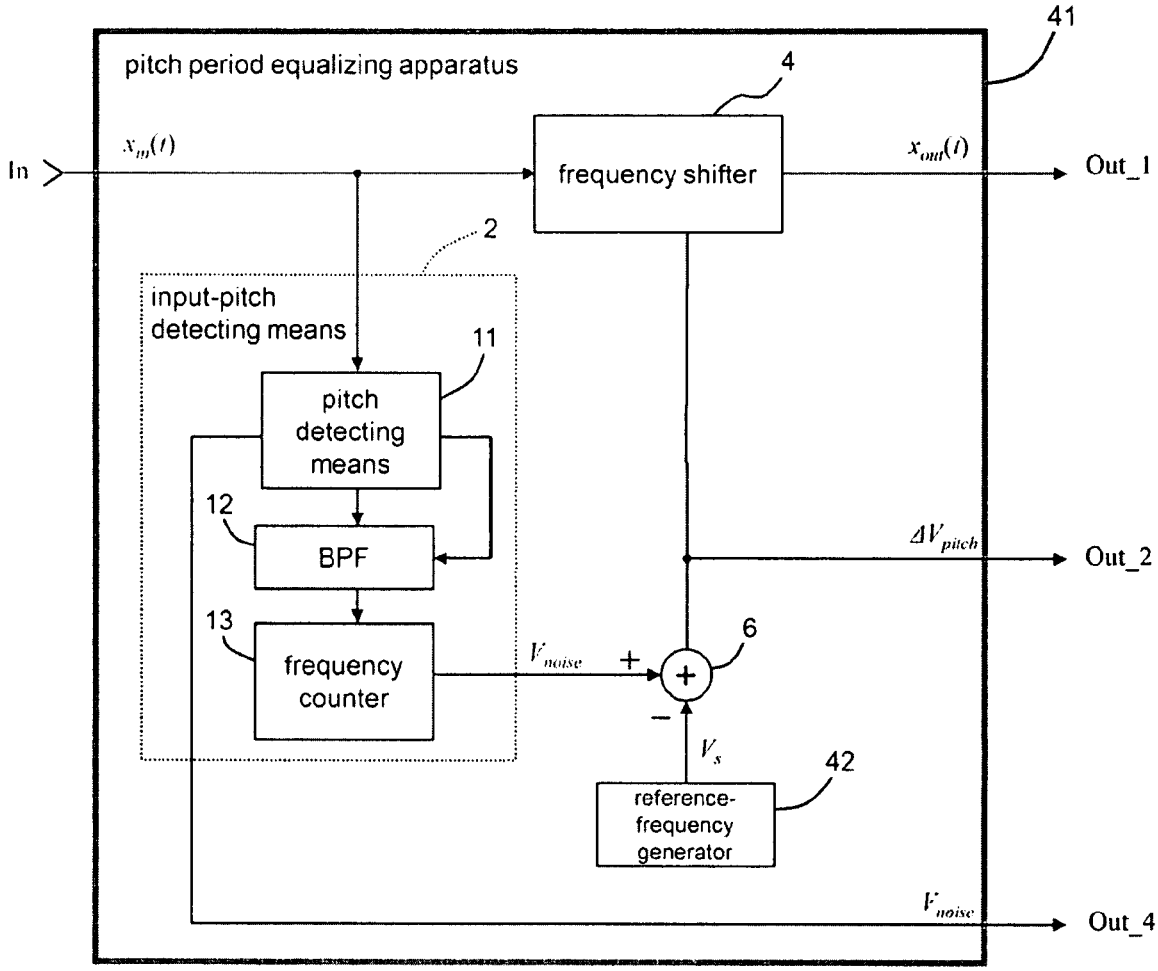
FIG. 12 is a diagram showing the structure of a pitch period equalizing apparatus 41 according to the fifth embodiment of the present invention.

FIG. 12 is a diagram showing the structure of a pitch period equalizing apparatus 41 according to the fifth embodiment of the present invention. The basic structure of the pitch period equalizing apparatus 41 according to the fifth embodiment is the same as that of the pitch period equalizing apparatus 1' according to the second embodiment and is however different therefrom in that a constant frequency is used as the reference frequency.

The pitch period equalizing apparatus 41 comprises: the input-pitch detecting means 2; the frequency shifter 4; residual calculating means 6; and a reference-frequency generator 42. The input-pitch detecting means 2, the frequency shifter 4, and the residual calculating means 6 are similar to those shown in FIG. 7 and a description thereof is thus omitted.

The reference-frequency generator 42 generates a predetermined constant reference frequency signal. The residual calculating means 6 subtracts the reference frequency signal $V_s$ from the basic frequency signal $V_{pitch}$ output by the input-pitch detecting means 2 and thus generates the residual frequency signal $\Delta V_{pitch}$. The residual frequency signal $\Delta V_{pitch}$ is fed forward to the frequency shifter 4. Other structures and operations are similar to those according to the second embodiment.

With this structure, the pitch period equalizing apparatus 41 separates the waveform information of the input speech signal $x_{in}(t)$ into the following information.

(a) Information indicating the voiced sound or the unvoiced sound;

(b) Information indicating the speech waveform at one pitch interval; and (c) Residual frequency information indicating the amount of deviation from the reference pitch frequency of the pitch frequency at each pitch interval.

The information is individually output as the noise flag signal $V_{noise}$, the output speech signal $x_{out}(t)$, and the residual frequency signal $\Delta V_{pitch}$. Unlike the second embodiment, the information on the reference pitch frequency is included in the residual frequency information indicating the amount of deviation from the reference pitch frequency of the pitch frequency at the pitch interval. In general, the pitch frequency does not greatly change and, even if the pitch frequency is included in the residual frequency information as mentioned above, the range of the residual frequency signal $\Delta V_{pitch}$ is not greatly large. Therefore, this operation also results in obtaining the pitch period equalizing apparatus 41 with high coding efficiency.

Sixth Embodiment

Figure 13:
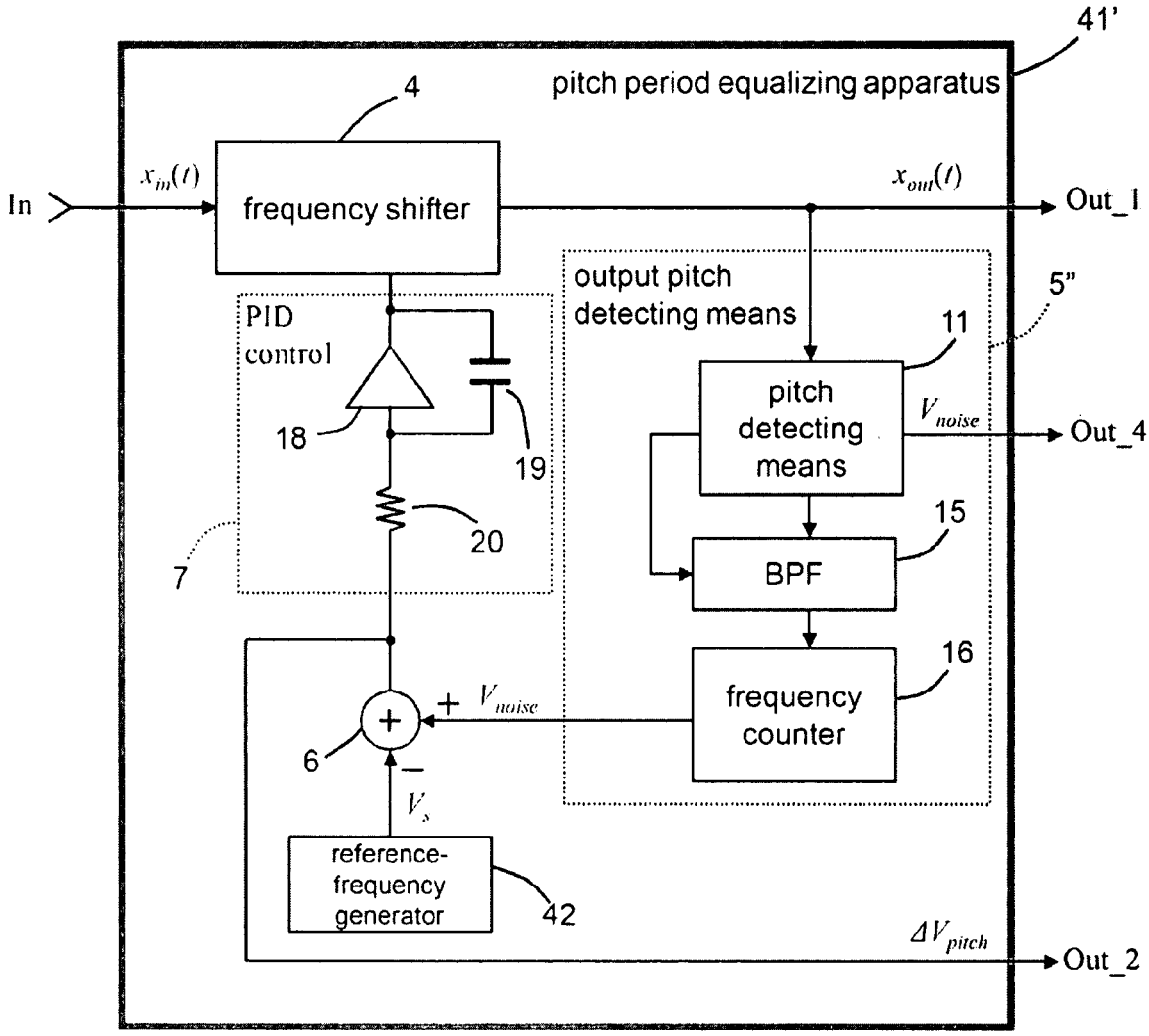
FIG. 13 is a diagram showing the structure of a pitch period equalizing apparatus 41' according to the sixth embodiment of the present invention.

FIG. 13 is a diagram showing the structure of a pitch period equalizing apparatus 41' according to the sixth embodiment of the present invention. The basic structure of the pitch period equalizing apparatus 41' according to the sixth embodiment is similar to the pitch period equalizing apparatus 1 according to the first embodiment and is however different therefrom in that a constant frequency is used as the reference frequency.

The pitch period equalizing apparatus 41' comprises: the frequency shifter 4; output pitch detecting means 5"; the residual calculating means 6; the PID controller 7; and the reference-frequency generator 42. The frequency shifter 4, the output pitch detecting means 5", and the residual calculating means 6 are similar to those shown in FIG. 8 and a description is therefore omitted. Further, the reference-frequency generator 42 is similar to that shown in FIG. 12.

The reference-frequency generator 42 generates a predetermined constant reference frequency signal. The residual calculating means 6 subtracts the reference frequency signal $V_s$ from the basic frequency signal $V_{pitch}'$ output by the output pitch detecting means 5", and thus generates the residual frequency signal $\Delta V_{pitch}$. The residual frequency signal $\Delta V_{pitch}$ is fedback to the frequency shifter 4 via the PID controller 7. Other structures and operations are similar to those according to the first embodiment.

With this structure, the pitch period equalizing apparatus 41' separates the waveform information of the input speech signal $x_{in}(t)$ into the following information.

(a) Information indicating the voiced sound or the unvoiced sound;

(b) Information indicating the speech information at one pitch interval; and (c) Residual frequency information indicating the amount of deviation from the reference pitch frequency of the pitch frequency at each pitch interval.

The information is individually output as the noise flag signal $V_{noise}$, the output speech signal $x_{out}(t)$, and the residual frequency signal $\Delta V_{pitch}$. Unlike the third embodiment, the information on the reference pitch frequency is included in the residual frequency information indicating the amount of deviation from the reference pitch frequency of the pitch frequency at each pitch interval. In general, the pitch frequency does not greatly change and, even if the pitch frequency is included in the residual frequency information as mentioned above, the range of the residual frequency signal $\Delta V_{pitch}$ is not greatly large. Therefore, the pitch period equalizing apparatus 41' with higher coding efficiency is obtained.

Seventh Embodiment

Figure 14:
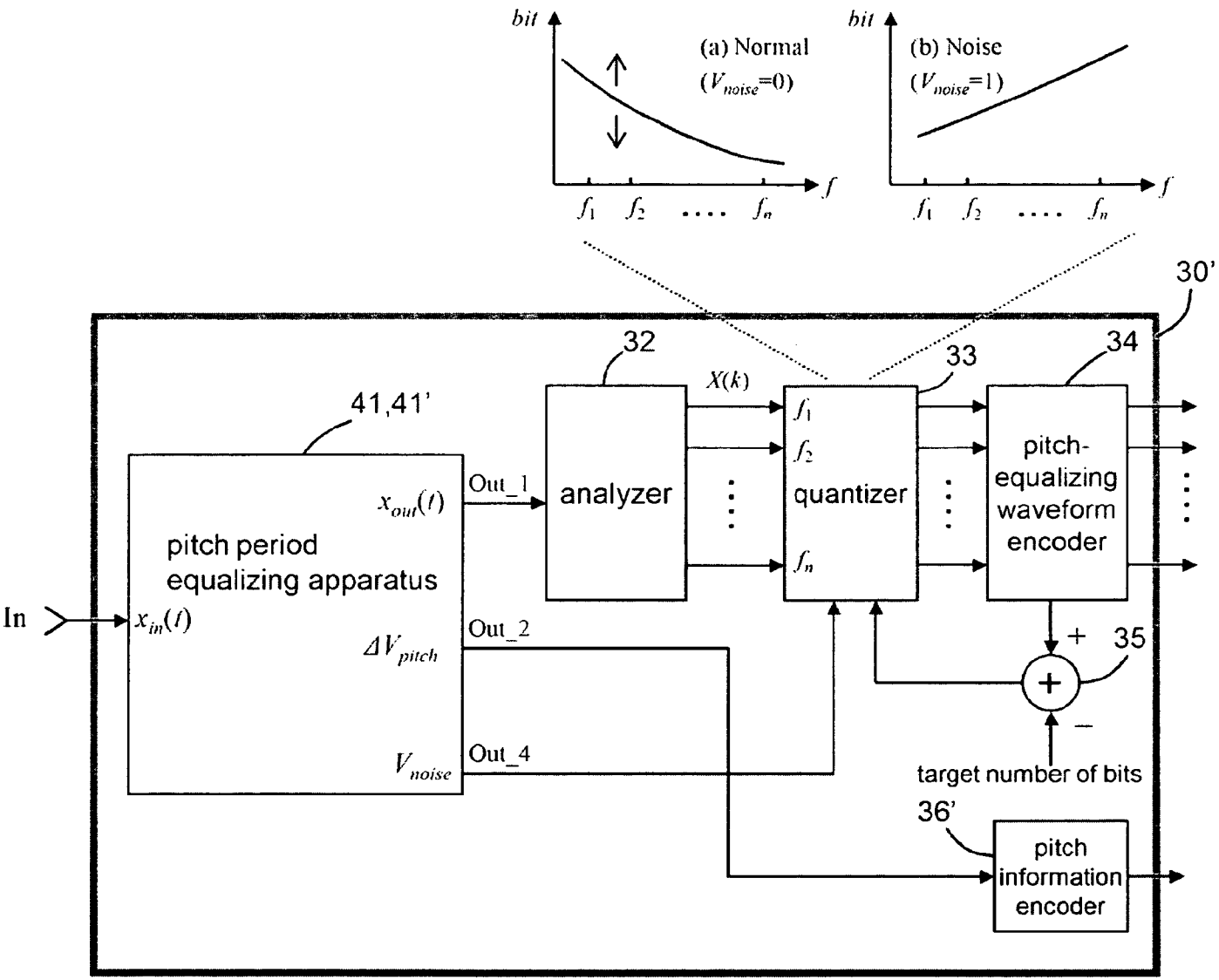
FIG. 14 is a diagram showing the structure of a speech coding apparatus 30' according to the seventh embodiment of the present invention.

FIG. 14 is a diagram showing the structure of a speech coding apparatus 30' according to the seventh embodiment of the present invention. The speech coding apparatus 30' comprises: the pitch period equalizing apparatuses 41 and 41'; the analyzer 32; the quantizer 33; the pitch-equalizing waveform encoder 34; the difference bit calculator 35; and a pitch information encoder 36'.

The analyzer 32, the quantizer 33, the pitch-equalizing waveform encoder 34, and the difference bit calculator 35 are similar to those according to the third embodiment. Further, the pitch period equalizing apparatuses 41 and 41' are the speech coding apparatus 30' according to the fifth or sixth embodiment.

With the pitch period equalizing apparatuses 41 and 41', the pitch period is always equalized to a constant reference period $1/f_s$. Therefore, the number of samples at one pitch interval is always constant, and the resampler 31 in the speech coding apparatus 30 according to the third embodiment is not required and is omitted. Further, since the pitch period is always equalized into the constant reference period $1/f_s$, the pitch period equalizing apparatuses 41 and 41' do not output the reference frequency signal $\Delta V_{pitch}$. Therefore, the pitch information encoder 36' encodes only the residual frequency signal $\Delta V_{pitch}$.

With this structure, the speech coding apparatus 30' using the pitch period equalizing apparatuses 41 and 41' is realized. The speech coding apparatus 30' is compared with the speech coding apparatus 30 according to the third embodiment and is different therefrom as follows.

(1) With the speech coding apparatus 30 according to the third embodiment, the reference frequency signal $\Delta V_{pitch}$ relatively time-based-changes and the resampling of the output speech signal $x_{out}(t)$ is therefore required. On the other hand, the speech coding apparatus 30' always has the constant reference frequency signal $V_s$ and does not need the resampling. As a consequence, the apparatus structure is simplified and processing time is fast.

(2) With the speech coding apparatus 30 according to the third embodiment, the pitch information is separated into the reference period information (reference frequency signal $\Delta V_{pitch}$) and the residual frequency information (residual frequency signal $\Delta V_{pitch}$). The individual information is encoded. On the other hand, with the speech coding apparatus 30', the reference period information is included in the residual frequency information (residual frequency signal $\Delta V_{pitch}$), and only the residual frequency information is encoded. As mentioned above, in the case of not separating the reference period information (i.e., time-based information of the average pitch frequency) and the residual frequency information, the range of the residual frequency signal $\Delta V_{pitch}$ is relatively larger than that according to the third embodiment. However, since the time-based change in average pitch frequency is small, if the range of residual frequency signal $\Delta V_{pitch}$ is relatively larger, the residual frequency signal $\Delta V_{pitch}$ still has a narrow range and the coding efficiency is not extremely reduced. Therefore, the high coding efficiency is obtained.

(3) With the speech coding apparatus 30', the pitch period at each pitch interval is forcedly equalized to a constant reference period. Therefore, in some cases, the difference between the pitch period of the input speech signal $x_{in}(t)$ and reference period is large. In this case, the equalization can cause slight distortion. As a consequence, as compared with the speech coding apparatus 30 according to the third embodiment, the reduction in S/N ratio due to the coding is relatively large.

Eighth Embodiment

Figure 15:
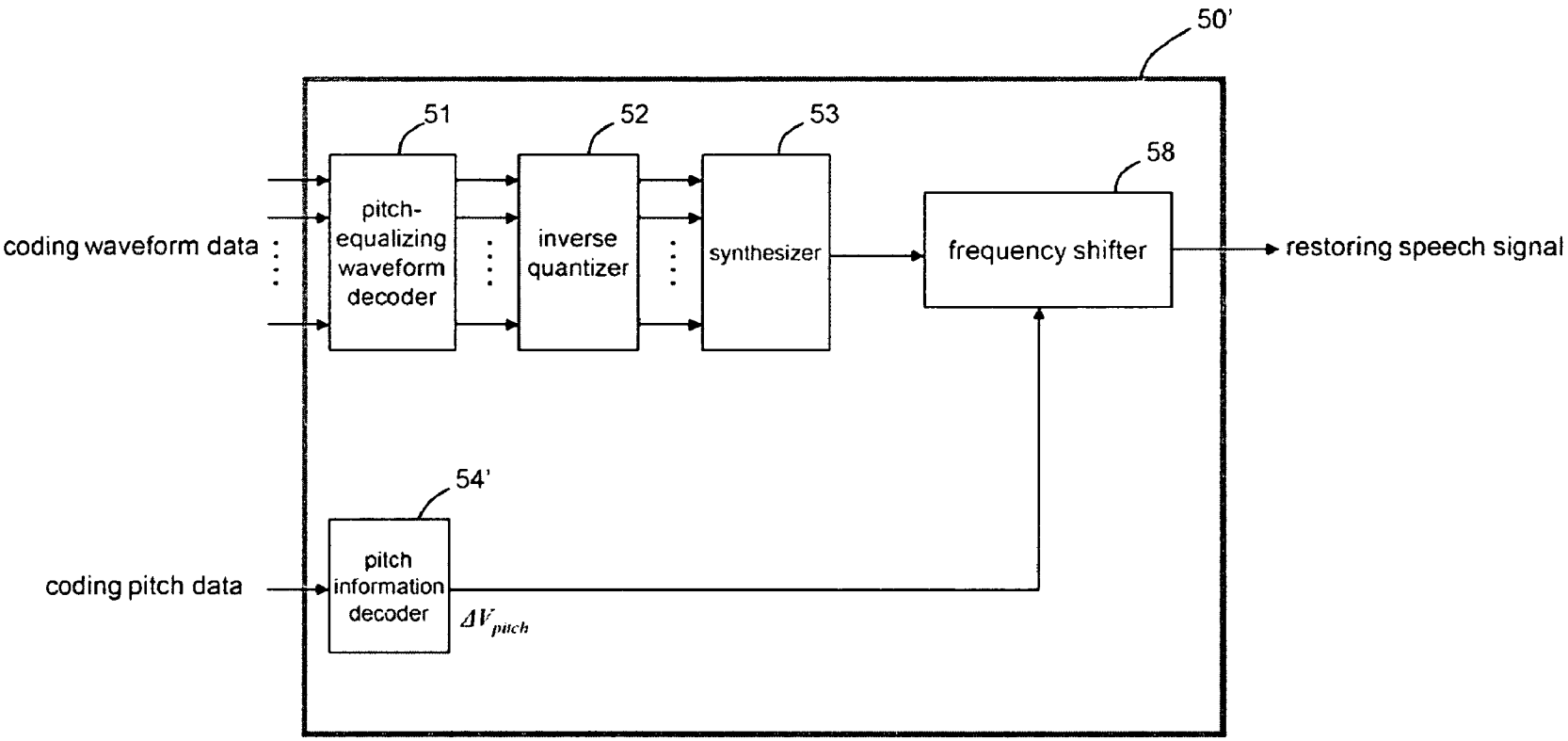
FIG. 15 is a block diagram showing the structure of a speech decoding apparatus 50' according to the eighth embodiment of the present invention.
Figure 16:
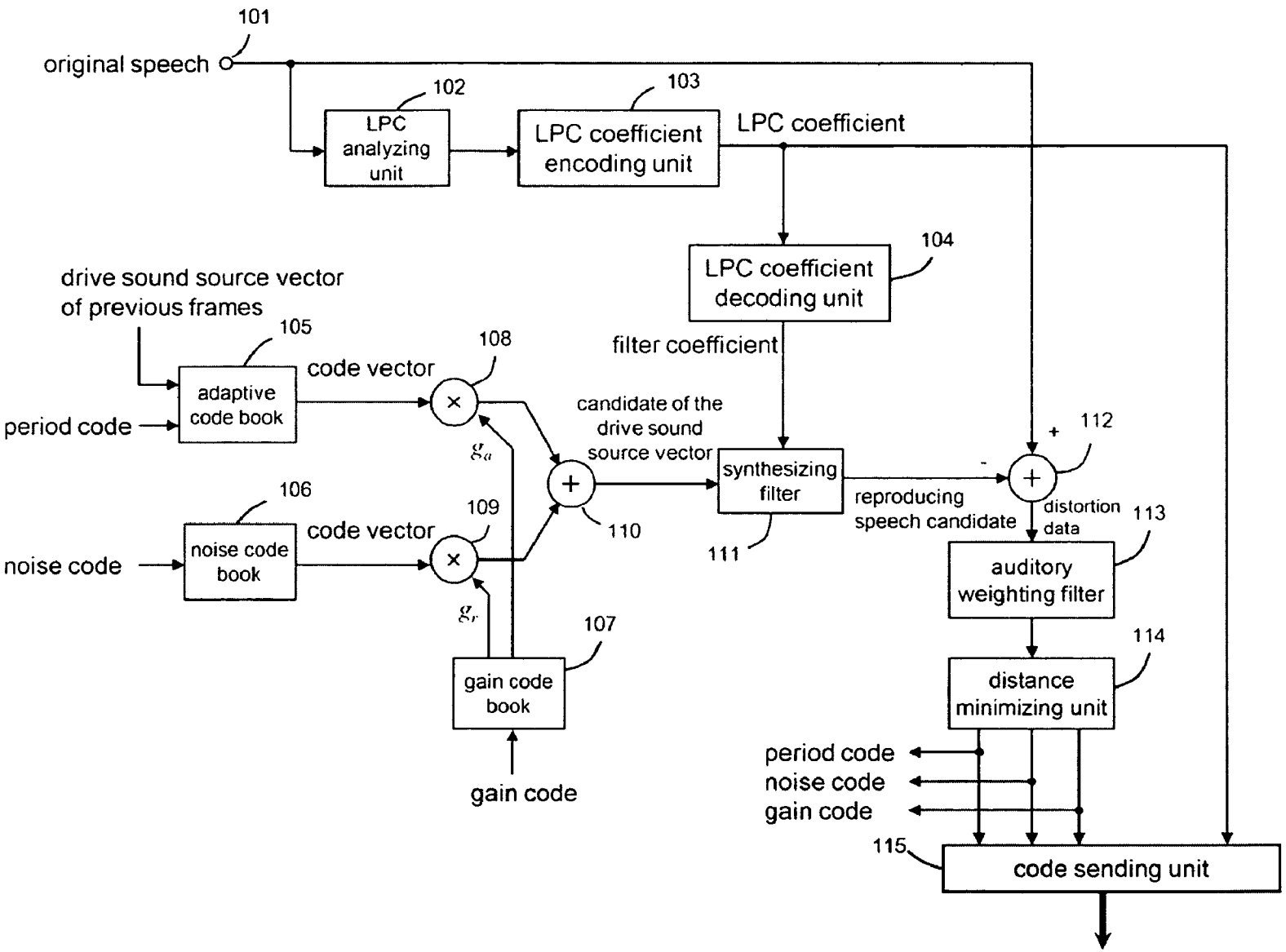
FIG. 16 is a diagram showing an example of the basic structure of a speech coding apparatus using CELP coding.
Figure 17:
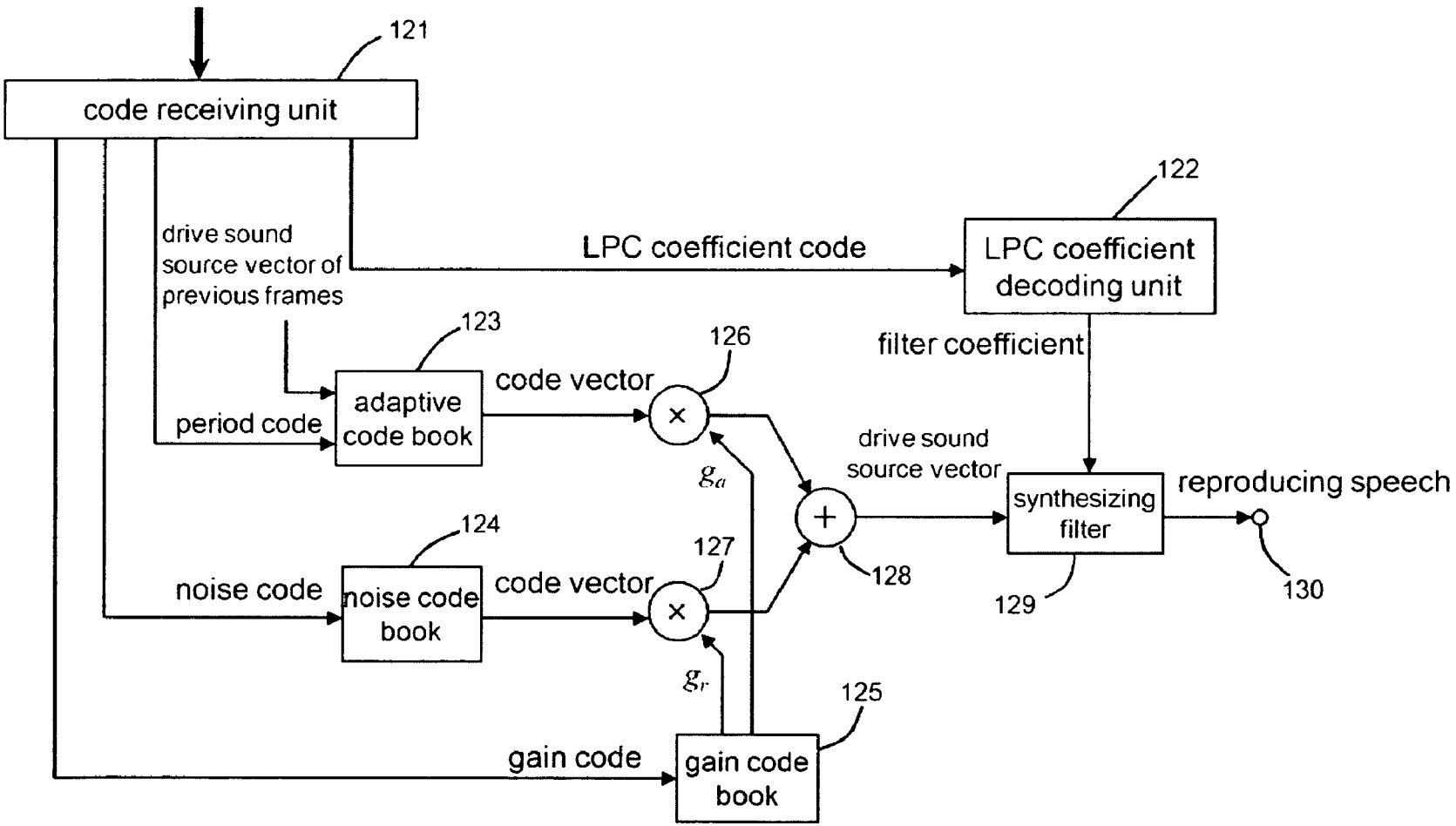
FIG. 17 is a diagram showing an example of the basic structure of a speech decoding apparatus using the CELP coding.
Figure 18:
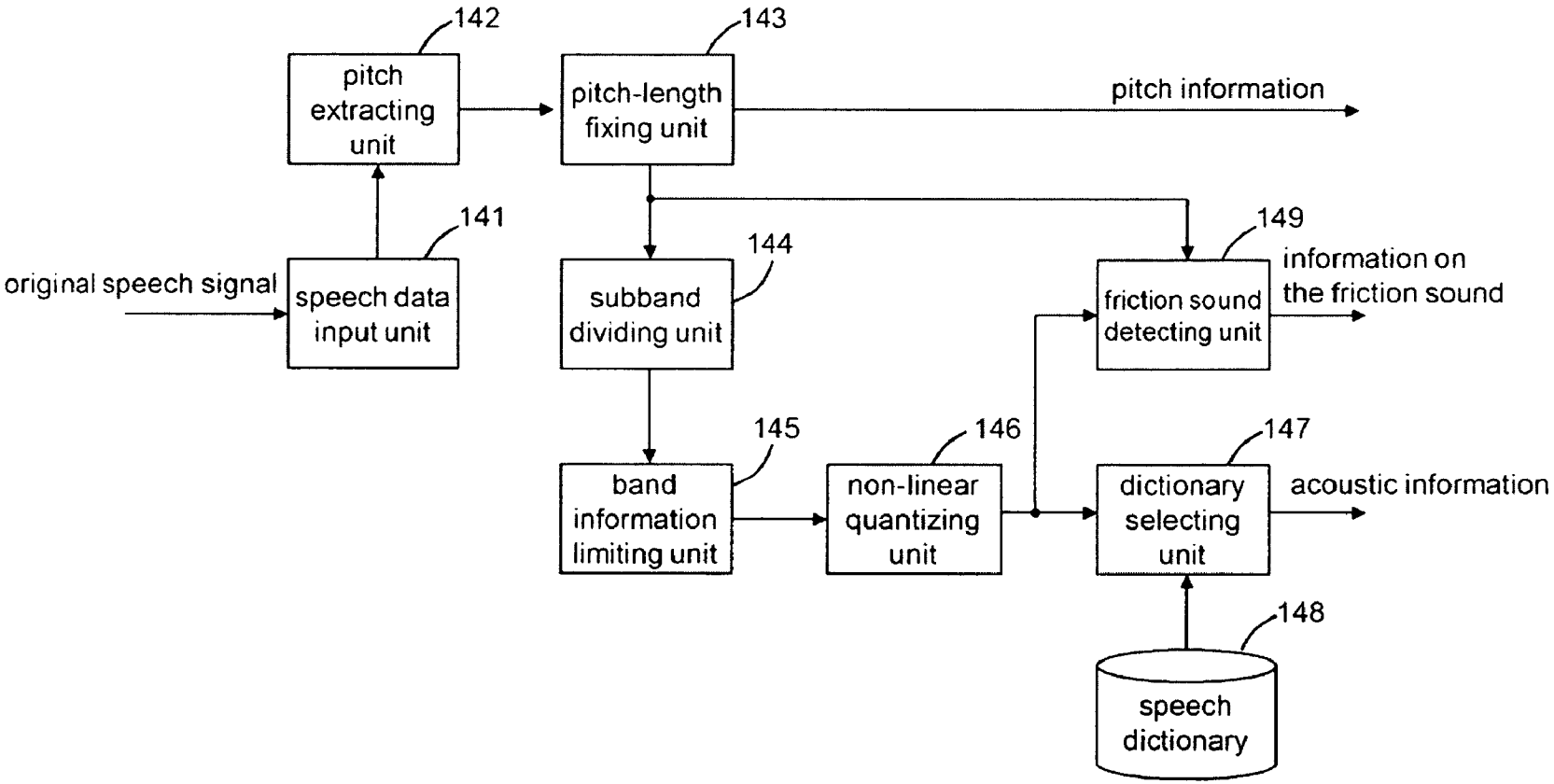
FIG. 18 is a diagram showing an example of the structure of a speech coding apparatus disclosed in Patent Document 2.

FIG. 15 is a block diagram showing the structure of a speech decoding apparatus 50' according to the eighth embodiment of the present invention. The speech decoding apparatus 50' decodes the speech signal encoded by the speech coding apparatus 30' according to the seventh embodiment. The speech decoding apparatus 50' comprises: a pitch-equalizing waveform decoder 51; the inverse quantizer 52; the synthesizer 53; a pitch information decoder 54'; and the frequency shifter 58. Of the components, the same components as those according to the fourth embodiment are designated by the same reference numerals.

The speech decoding apparatus 50' inputs the coding waveform data and the coding pitch data. The coding waveform data is output from the pitch-equalizing waveform encoder 34 shown in FIG. 14. The coding pitch data is output from the pitch information encoder 36' shown in FIG. 14.

The speech decoding apparatus 50' according to the eighth embodiment is formed by omitting the pitch frequency detecting means 55, the difference unit 56, and the adder 57 from the speech decoding apparatus 50 according to the fourth embodiment. The pitch information decoder 54' decodes the coding pitch data, thereby restoring the residual frequency signal $\Delta V_{pitch}$. The frequency shifter 58 transforms the pitch frequency at the pitch interval of the equalized speech signal $x_{eq}(t)$ output by the synthesizer 53 into a signal obtained by adding the residual frequency signal $\Delta V_{pitch}$ to the pitch frequency, and restores the transformed signal as the speech signal $x_{res}(t)$. Other operations are the same as those according to the fourth embodiment.

Incidentally, the pitch period equalizing apparatuses 1 and 1', the speech coding apparatuses 30 and 30', and the speech decoding apparatuses 50 and 50' according to the first to eighth embodiments are examples of the hardware structure. However, the functional blocks may be structured as programs and may be then executed by a computer, thereby allowing the computer to function as the apparatuses.

The invention claimed is:

1. A pitch period equalizing apparatus that equalizes a pitch period of voiced sound of an input speech signal, comprising:

pitch detecting means that detects a pitch frequency of the speech signal;

residual calculating means that calculates a residual frequency, as the difference obtained by subtracting a predetermined reference frequency from the pitch frequency; and a frequency shifter that equalizes the pitch period of the speech signal by shifting the pitch frequency of the speech signal in a direction for being close to the reference frequency on the basis of the residual frequency, wherein the frequency shifter comprises:

modulating means that modulates an amplitude of the input signal by a predetermined modulating wave and generates the modulated wave;

a band-pass filter that allows only a signal having a single side band component of the modulated wave to selectively pass through;

demodulating means that demodulates the modulated wave subjected to the filtering of the band-pass filter by a predetermined demodulating wave and outputs the demodulated wave as an output speech signal; and frequency adjusting means that sets, as a predetermined basic carrier frequency, one of a frequency of the modulating wave used for modulation of the modulating means and a frequency of the demodulating wave used for demodulation of the demodulating means, and sets the other frequency to a frequency obtained by subtracting the residual frequency from the basic carrier frequency.

2. The pitch period equalizing apparatus according to claim 1, wherein the pitch detecting means comprises:

input pitch detecting means that detects an input pitch frequency of the input speech signal input to the frequency shifter; and output pitch detecting means that detects an output pitch frequency of the output speech signal output from the frequency shifter, and the pitch period equalizing apparatus further comprises:

pitch averaging means that calculates an average pitch frequency as the time-based average of the input pitch frequencies, and the residual calculating means sets the average pitch frequency as a reference frequency, and calculates a residual frequency as the difference between the output pitch frequency and the reference frequency.

3. The pitch period equalizing apparatus according to claim 1, wherein the pitch detecting means is an input pitch detecting means that detects an input pitch frequency of the input speech signal input to the frequency shifter, and comprises:

pitch averaging means that calculates an average pitch frequency as the time-based average of the input pitch frequencies, and the residual calculating means sets the average pitch frequency as a reference frequency and calculates a residual frequency as the difference between the input pitch frequency and the reference frequency.

4. The pitch period equalizing apparatus according to claim 1, wherein the pitch detecting means is output pitch detecting means that detects an output pitch frequency of the output speech signal output from the frequency shifter, and comprises:

pitch averaging means that calculates an average pitch frequency as the time-based average of the output pitch frequencies, and the residual calculating means sets the average pitch frequency as a reference frequency, and calculates a residual frequency between the output pitch frequency and the reference frequency.

5. The pitch period equalizing apparatus according to claim 1, wherein the pitch detecting means is input pitch detecting means that detects an input pitch frequency of the input speech signal input to the frequency shifter, and comprises reference frequency generating means that outputs the reference frequency, and the residual calculating means calculates a residual frequency as the difference between the input pitch frequency and the reference frequency.

6. The pitch period equalizing apparatus according to claim 1, wherein the pitch detecting means is output pitch detecting means that detects an output pitch frequency of the output speech signal output from the frequency shifter, and comprises:

reference frequency generating means that outputs the reference frequency, and the residual calculating means calculates a residual frequency as the difference between the output pitch frequency and the reference frequency.

7. A speech coding apparatus that encodes an input speech signal, comprising:

the pitch period equalizing apparatus according to claim 1 that equalizes a pitch period of voiced sound of the speech signal; and orthogonal transforming means that orthogonally transforms a pitch-equalizing speech signal output by the pitch period equalizing apparatus at an interval of a constant number of pitches, and generates transforming coefficient data of a subband.

8. The speech coding apparatus according to claim 7, further comprising:

resampling means that performs resampling of the pitch-equalizing speech signal output by the pitch period equalizing apparatus so that the number of samples at one pitch interval is constant.

9. A speech decoding apparatus that decodes an original speech signal on the basis of a pitch-equalizing speech signal obtained by equalizing a pitch frequency of the original speech signal to a predetermined reference frequency and by resolving the equalized pitch frequency to a subband component with orthogonal transformation and a residual frequency signal as the difference obtained by subtracting the reference frequency from the pitch frequency of the original speech signal, the speech decoding apparatus comprising:

inverse-orthogonal transforming means that restores a pitch-equalizing speech signal by orthogonally inverse-transforming the pitch-equalizing speech signal orthogonally-transformed at a constant number of pitches; and a frequency shifter that generates the restoring speech signal by shifting the pitch frequency of the pitch-equalizing speech signal to be close to a frequency obtained by adding the residual frequency to the reference frequency, and wherein the frequency shifter comprises:

modulating means that modulates an amplitude of the pitch-equalizing speech signal by a predetermined modulating wave and generates the modulated wave;

a band-pass filter that allows only a signal of a single side band component of the modulated signal to selectively pass through;

demodulating means that demodulates the modulated wave subjected to the filtering by the band-pass filter by a predetermined demodulating wave and outputs the demodulated wave as a restoring speech signal; and frequency adjusting means that sets, as a predetermined basic carrier frequency, one of a frequency of the modulating wave used for modulation by the modulating means and a frequency of the demodulating wave used for demodulation by the demodulating means, and sets the other frequency to a value obtained by adding the residual frequency to the basic carrier frequency.

10. A pitch period equalizing method that equalizes a pitch period of voiced sound of an input speech signal using a pitch period equalizing apparatus, the pitch period equalizing method comprising:

a frequency shifting step of inputting the input speech signal to a frequency shifter and obtaining an output speech signal from the frequency shifter;

an output pitch detecting step using an output pitch detecting means for detecting an output pitch frequency of the output speech signal; and a residual frequency calculating step using a residual calculating means for calculating a residual frequency as the difference between the output pitch frequency and a predetermined reference frequency, wherein the frequency shifting step comprises:

a frequency setting step of setting one of a frequency of a modulating wave used for modulation and a frequency of a demodulating wave used for demodulation to a predetermined basic carrier frequency, and setting the other frequency to a frequency obtained by subtracting the residual frequency calculated by the residual frequency calculating step from the basic carrier frequency;

a modulating step of modulating an amplitude of the input speech signal by the modulating wave and generating the modulated wave;

a band reducing step of performing filtering of the modulated wave by a band-pass filter that allows only a single side band component of the modulated wave to pass through; and a demodulating step of demodulating the modulated wave subjected to the filtering of the band-pass filter by the demodulating wave and outputting the demodulated wave as an output speech signal.

11. The pitch period equalizing method according to claim 10, further comprising:

a pitch averaging step of calculating an average pitch frequency as the time-based average of the output pitch frequencies, wherein the residual frequency calculating step uses the residual calculating means to calculate the difference between the output pitch frequency and the average pitch frequency, and sets the calculated difference as the residual frequency.

12. The pitch period equalizing method according to claim 10, further comprising:

an input pitch detecting step using an input pitch detecting means for detecting an input pitch frequency of the input speech signal; and a pitch averaging step of calculating an average pitch frequency as the time-based average of the input pitch frequencies, wherein the residual frequency calculating step using the residual calculating means to calculate the difference between the output pitch frequency and the average pitch frequency, and sets the calculated difference as the residual frequency.

13. A pitch period equalizing method that equalizes a pitch period of voiced sound of an input speech signal using a pitch period equalizing apparatus, the pitch period equalizing method comprising:

an input pitch detecting step using an input pitch detecting means for detecting an input pitch frequency of the input speech signal;

a frequency shifting step of inputting the input speech signal to a frequency shifter and obtaining an output speech signal from the frequency shifter; and a residual frequency calculating step of calculating a residual frequency as the difference obtained by subtracting a predetermined reference frequency from the input pitch frequency, wherein the frequency shifting step comprises:

a frequency setting step of setting one of a frequency of a modulating wave used for modulation and a frequency of a demodulating wave used for demodulation to a predetermined basic carrier frequency, and setting the other frequency to a frequency obtained by subtracting the residual frequency calculated by the residual frequency calculating step from the basic carrier frequency;

a modulating step of modulating an amplitude of the input speech signal by the modulating wave and generating a modulated wave;

a band reducing step of performing filtering of the modulated wave by a band-pass filter that allows only a single side band component of the modulated wave; and a demodulating step of demodulating the modulated wave subjected to the filtering with the band-pass filter by the demodulating wave and outputting the demodulated wave as an output speech signal.

14. The pitch period equalizing method according to claim 13, further comprising:

a pitch averaging step of calculating an average pitch frequency as the time-based average of the input pitch frequencies, wherein the residual frequency calculating step calculates the difference between the input pitch frequency and the average pitch frequency, and sets the calculated difference as the residual frequency.

15. A speech coding method that encodes an input speech signal, comprising:

a pitch period equalizing step of equalizing a pitch period of voiced sound of the speech signal with the pitch period equalizing method according to claim 10;

an orthogonal transforming step of orthogonally transforming a pitch-equalizing speech signal equalized by the pitch period equalizing step at a constant number of pitches, and generating transforming coefficient data of a subband; and a waveform coding step of encoding the transforming coefficient data.

16. The speech coding method according to claim 14, further comprising:

a resampling step of performing resampling of the pitch-equalizing speech signal equalized by the pitch period equalizing step so that the number of samples at one pitch interval is constant.

17. A program that is executed by a computer to enable the computer to function as the pitch period equalizing apparatus according to claim 1.

18. A program that is executed by a computer to enable the computer to function as the speech coding apparatus according to claim 7.

19. A program that is executed by a computer to enable the computer to function as the speech decoding apparatus according to claim 9.

20. A speech coding method that encodes an input speech signal, comprising:

a pitch period equalizing step of equalizing a pitch period of voiced sound of the speech signal with the pitch period equalizing method according to claim 13;

an orthogonal transforming step of orthogonally transforming a pitch-equalizing speech signal equalized by the pitch period equalizing step at a constant number of pitches, and generating transforming coefficient data of a subband; and a waveform coding step of encoding the transforming coefficient data.

* * * * *